US006048000A

United States Patent [19]

Geringer et al.

[11] Patent Number: 6,048,000

[45] Date of Patent: Apr. 11, 2000

[54] DELAYED EGRESS PANIC DEVICE WITH INTERNAL DEADLOCKING BOLT MECHANISM

[76] Inventors: Arthur Geringer, 5029 E. Jacobs Ct., Agoura, Calif. 91301; Richard Geringer, 12628 Ambermeadow St., Moorpark, Calif. 93021; David Geringer, 28364 Balkin, Agoura, Calif. 91301

[21] Appl. No.: 09/067,944

[22] Filed: Apr. 28, 1998

[51] Int. Cl.[7] ..... E05B 65/10

[52] U.S. Cl. ..... 292/92; 292/DIG. 65; 292/166; 70/92

[58] Field of Search ..... 292/92, 21, 93, 292/144, 94, 5, 7, 166, 192, DIG. 25, DIG. 65, 150; 70/92

[56] References Cited

U.S. PATENT DOCUMENTS

| | | | |
|---|---|---|---|
| 3,614,145 | 10/1971 | Zawadski | 292/201 |
| 3,767,238 | 10/1973 | Zawadzki | 292/21 |
| 4,631,528 | 12/1986 | Handel et al. | 292/92 |
| 4,709,950 | 12/1987 | Zortman | 292/92 |
| 4,784,415 | 11/1988 | Malaval | 292/150 |
| 4,796,931 | 1/1989 | Heid | 292/DIG. 60 |
| 4,875,722 | 10/1989 | Miller et al. | 292/92 |
| 5,219,385 | 6/1993 | Yeh | 292/92 |
| 5,322,332 | 6/1994 | Toledo et al. | 292/92 |
| 5,340,171 | 8/1994 | Slaybaugh et al. | 292/21 |
| 5,429,399 | 7/1995 | Geringer et al. | 292/92 |
| 5,605,362 | 2/1997 | Surko, Jr. | 292/92 |
| 5,630,631 | 5/1997 | Iwamoto et al. | 292/150 |
| 5,823,582 | 10/1998 | Frolov et al. | 292/92 |

*Primary Examiner*—Teri Pham
*Attorney, Agent, or Firm*—John J. Posta, Jr.

[57] ABSTRACT

An improved door access bar for installation onto a door through which access is controlled by an electrically operated door access system is disclosed in which the door access bar has an electromechanically operable door locking mechanism which is used to selectively lock and unlock the door to thereby control access or egress through the door. The door access locking bar of the present invention incorporates an interlock mechanism to prevent the bolt from being forced into a retracted position by jimmying the locking mechanism to unlock the door. The locking mechanism of the present invention prevents the door from being opened until the electromechanical locking mechanism is operated to do so. The door access locking bar of the present invention operates in a fail-safe manner so that in the event of a power failure it will automatically be in an unlocked position.

34 Claims, 16 Drawing Sheets

76
72
70
68
74
66
64
80
60
62
78

72
70
68
66
64
60
62

100
102
104
96
94
98
68

178
242
176
106
188
244
182
180
190
218
220
222
70
226
240
112
234
232
236
94
108
84
174
122
66
68

178
242
176
106
188
244
182
180
190
218
220
222
70
226
240
112
232
234
236
94
108
84
122
66
68
174

176
242
178
188
106
182
180
190
220
222
226
110
108
82
174
118
232
236
66
68
70
234
96
218
240
244

220
234
236
68
252
260
248
260

220
234
236
68
252
250
248
250

220
234
236
68
252
250
248
250

264
22
22
260
256
64

346
348
336
340
342
334

260
258
64

316
318
314
310

318
312
310

334
336

348
350
352
354
356
358
360
362
364
366
368

348
350
352
354
362
364
366
368

370
372
38
38

370
372

384
386
388
390
392
394
396
398
400

62
404
406
408
410
412
414
416
422
424
428
48
62

DELAYED EGRESS PANIC DEVICE WITH INTERNAL DEADLOCKING BOLT MECHANISM

BACKGROUND OF THE INVENTION

Field of the Invention

The present invention relates generally to electrically operated door locking systems in which the door is unlocked by accessing an electronic control system, and more particularly to an improved door access bar for installation onto a door through which access is controlled by an electrically operated door access system, whereby the door access bar has an electromechanically operable door locking mechanism which is used to selectively lock and unlock the door to thereby control access or egress through the door.

Security doors to prevent theft or vandalism have evolved over the years from simple doors with heavy duty locks to more sophisticated egress and access control devices. Hardware and systems for limiting and controlling egress and access through doors are generally utilized for theft-prevention or to establish a secured area into which (or from which) entry is limited. For example, stores use such secured doors in certain departments (such as, for example, the automotive department) which may not always be manned to prevent thieves from escaping through the door with valuable merchandise. In addition, industrial companies also use such secured exit doors to prevent pilferage of valuable equipment and merchandise.

Such doors and systems have evolved over the years from simple doors having heavy duty mechanical locks thereon to sophisticated egress and access control devices. In bygone times, heavy duty chains and locks were the norm on security doors which were not generally used, or which were used to prevent theft or vandalism. However, fire codes have made such relatively simple door locking systems obsolete, at least in most developed countries. Emergency exit doors are required by law to be provided in all commercial buildings, and such doors must be operative in the event of a fire, earthquake, or other emergency.

These exit doors are typically provided with heavy horizontal push bars, which unlock the door upon actuation and which may provide an alarm of some sort. The early alarms on such doors were either mechanical in nature, such as wind-up alarms contained on the push bar mechanism, or completely separate electrical circuits actuated by a switch opened as the door was opened. Accordingly, egress from such doors was immediate, and, although egress was accompanied by an alarm, typically the person leaving through the door was long gone by the time security personnel arrived.

As might be expected, the art reflects a number of emergency exit access activation devices which attempt to solve this problem. An example of one such device is found in U.S. Pat. No. 4,257,631, to Logan, Jr., which describes a system activated by a push bar which, upon depression, moves a switch carried by the door to sound an alarm and start a timer delay. After the delay, the door is unlocked.

This type of device in which a push bar containing an electrical switch therein is used to initiate a request for access or egress is by far the most common. Several other types of systems have been proposed, and, although none of these systems has found great acceptance, a brief discussion of them is in order.

U.S. Pat. No. 4,328,985 and U.S. Pat. No. 4,354,699, both also to Logan, teach a hydraulic system for accomplishing the delay prior to unlocking the door, and a retrofit locking device of the same type which is usable with any door latching system, respectively. These two systems are thus mechanical rather than electrical in nature.

A door access bar utilizing an electric switch to actuate a discrete electrically operated locking mechanism is illustrated in U.S. Pat. No. 5,564,228, to Geringer et al. The improved door access bar of the Geringer et al. '228 patent contains an electromechanical mechanism through which mechanical contact by a user with the door access bar is translated into an electrical output, which may be utilized to initiate the process of unlocking the door on which the door access bar is mounted. The transducer used by the door access bar of the Geringer et al. '228 patent is a force sensing resistor (FSR), which has a resistance which drops when a compressive force exerted across the force sensing resistor increases.

Despite its disadvantages, the preferred type of door access bar is the mechanically operated door access bar with an electrical switch incorporated therein to control an integral locking mechanism. Accordingly, it is the primary objective of the present invention that it present an improved door access bar having an electromechanical locking mechanism incorporated therein to selectively lock and unlock a door on which the door access locking bar is mounted to thereby control access or egress through the door. It is a related objective that the locking mechanism will positively prevent the door from being opened until the electromechanical locking mechanism is operated to do so, it is another primary objective of the door access locking bar of the present invention that the locking mechanism be integrated into the design of the door access locking bar, and that the locking mechanism not be visible from the exterior of the door access locking bar.

It is a closely related objective of the door access locking bar of the present invention that the switch which indicates that access or egress is desired be triggered by pressure on the door access locking bar. It is a further objective of the door access locking bar of the present invention that despite the incorporation of these aspects it present a low-profile design similar to that of a conventional door access bar. It is still another primary objective of the door access locking bar of the present invention that its mechanical design incorporate an interlock mechanism to positively prevent the bolt from being forced into a retracted position by jimmying the locking mechanism to unlock the door.

It is a further objective that the door access locking bar of the present invention operate in a fail-safe manner such that, in the event of a power failure, the door access locking bar will automatically be placed into an unlocked position. It is an additional objective of the door access locking bar of the present invention that it allow the bolt to retract as the door is closed without first requiring the unlocking mechanism to be actuated. It is a still further objective of the door access locking bar of the present invention that it be of a robust design so as to not require frequent adjustment of mechanical tolerances within the device, and that it be both easy and quick to mount on any door or other desired location.

The door access locking bar of the present invention must be of a construction which is both durable and long lasting, and it should also require little or no maintenance to be provided by the user throughout its operating lifetime. In order to enhance the market appeal of the door access locking bar of the present invention, it should also be of inexpensive construction to thereby afford it the broadest possible market. Finally, it is also an objective that all of the aforesaid advantages and objectives of the apparatus of the door access locking bar of the present invention be achieved without incurring any substantial relative disadvantage.

SUMMARY OF THE INVENTION

The disadvantages and limitations of the background art discussed above are overcome by the present invention. With this invention, a door access locking bar of conventional appearance for mounting on the surface of a door is provided. The door access locking bar consists of five main components: a latching mechanism assembly, a pressure bar assembly, a solenoid actuator, a lock plate, and a base rail onto which the other components are mounted. The door access locking bar is mounted on a door, and has a pivoting bolt which engages a strike plate of conventional design which is mounted in a door frame.

The latching mechanism assembly has a pivoting bolt which is conventional in its outward appearance. The bolt is driven by a pivoting drive arm which moves between first and second angular positions. In the first position, the drive arm does not engage the bolt. When the drive arm moves to its second position, it will engage the bolt, retracting it into the latching mechanism. The drive arm is driven to operate the bolt as well as the rest of the latching mechanism (by the pressure bar, as will become apparent below).

An interlock mechanism is an integral part of the latching mechanism, and has several functions. First, the interlock mechanism allows the bolt to be retracted when the door is closed regardless of the position of the drive arm. Second, the interlock mechanism prevents the bolt from being forced into a retracted position when the door has been closed, thereby preventing the lock from being jimmied open by force. Third, the interlock mechanism operates a switch which will indicate the status of the door access locking bar, and which functions to indicate that access or egress through the door is desired.

The switch is capable of indicating when the door is in the open position with the bolt extending, when the door is in the closed position, when the pressure bar has been depressed to incrementally move the drive arm indicating that access or egress is desired, and when the pressure bar has been fully depressed to move the drive arm to retract the bolt. The signal from the switch may be used to operate a locking system to operate the solenoid to cause the door access locking bar to be unlocked, either immediately or following a desired delay period.

The drive arm is also connected to drive a pivoting pin, which extends from the latching mechanism. As the drive arm moves between first and second positions, it moves the pivoting pin between first and second positions. When the pivoting pin is retained in its first position, it will prevent the drive arm from moving to its second position, thereby preventing the drive arm from retracting the bolt into the latching mechanism.

The latching mechanism is mounted onto one end of the base rail. The base rail is H-shaped in cross-section, and the latching mechanism is mounted onto the crossbar of the H on one side (the top side) thereof. When the latching mechanism is so mounted, the pivoting pin of the latching mechanism extends through a slot in the crossbar of the H and is moveable between its first and second positions.

The pressure bar is mounted with a support mechanism on the base rail on the same side (the top side) of the crossbar of the H as the latching mechanism for reciprocating movement between a first position relatively away from the base rail and a second position relatively closer to the base plate. The base rail is spring biased by its support mechanism into its first position. The drive arm of the latching mechanism is driven by the movement of the base rail between its two positions. When the base rail moves from its first position to its second position, it will drive the drive arm from its first position to its second position. When the base rail moves back from its second position to its first position, it allows the drive arm to move from its second position to its first position.

The solenoid actuator is also mounted in the base rail, on the same side (the top side) of the crossbar of the H of the base rail as is the pressure bar. The solenoid actuator has a reciprocating shaft which it drives from a first retracted position (into which it is biased) to a second extended position when it is energized. The solenoid actuator is mounted in the base rail so that its shaft extends through an aperture in the crossbar of the H of the base rail when it is in its second position.

Finally, the lock plate is mounted in the base rail on the opposite side (the bottom side) of the crossbar of the H of the base rail. The lock plate is longitudinally moveable on the base rail between first and second positions, and has an aperture therein which engages the pivoting pin of the latching mechanism. As the pivoting pin moves between its first and second positions, it will move the lock plate between its first and second positions (assuming that the lock plate is free to so move).

The lock plate has another aperture therein for receiving the shaft of the solenoid actuator therein when the lock plate is in its first position and when the solenoid actuator is energized to move the shaft to its second extended position. When the shaft engages the aperture in the lock plate, the lock plate will not be able to move to its second position. This prevents the pivoting pin from moving from its first position to its second position, which in turn prevents the drive arm from moving from its first position to its second position. Thus, when the shaft of the solenoid actuator engages the lock plate, the latching mechanism will not be able to retract the bolt into the latching mechanism.

In the preferred embodiment, the aperture in the lock plate into which the pivoting pin extends has a small amount of play. This is necessary to allow the pressure bar to move the drive arm a small amount, which actuates the switch in the latching mechanism to thereby indicate that access or egress through the door has been requested.

It may therefore be seen that the present invention teaches an improved door access bar having an electromechanical locking mechanism incorporated therein to selectively lock and unlock a door on which the door access locking bar is mounted to thereby control access or egress through the door. The locking mechanism of the door access locking bar of the present invention will positively prevent the door from being opened until the electromechanical locking mechanism is operated to do so. The locking mechanism is integrated into the design of the door access locking bar, and is not visible from the exterior of the door access locking bar.

The switch of the door access locking bar of the present invention which indicates that access or egress is desired is triggered by pressure on the door access locking bar. Despite the incorporation of these aspects, the door access locking bar of the present invention presents a low-profile design similar to that of a conventional door access bar. The mechanical design of the door access locking bar of the present invention incorporates an interlock mechanism to positively prevent the bolt from being forced into a retracted position by jimmying the locking mechanism to unlock the door.

The door access locking bar of the present invention operates in a fail-safe manner such that, in the event of a power failure, it will automatically be placed into an unlocked position. It allows the bolt to retract as the door is closed without first requiring that the unlocking mechanism be actuated. The door access locking bar of the present invention is of a robust design so as to not require frequent adjustment of mechanical tolerances within the device, and is both easy and quick to mount on any door or other desired location.

The door access locking bar of the present invention is of a construction which is both durable and long lasting, and which will require little or no maintenance to be provided by the user throughout its operating lifetime. It is also of inexpensive construction to enhance its market appeal and to thereby afford it the broadest possible market. Finally, all of the aforesaid advantages and objectives of the apparatus of the door access locking bar of the present invention are achieved without incurring any substantial relative disadvantage.

DESCRIPTION OF THE DRAWING

These and other advantages of the present invention are best understood with reference to the drawings, in which.

DETAILED DESCRIPTION OF THE PREFERRED EMBODIMENT

Figures 1, 2, 3:
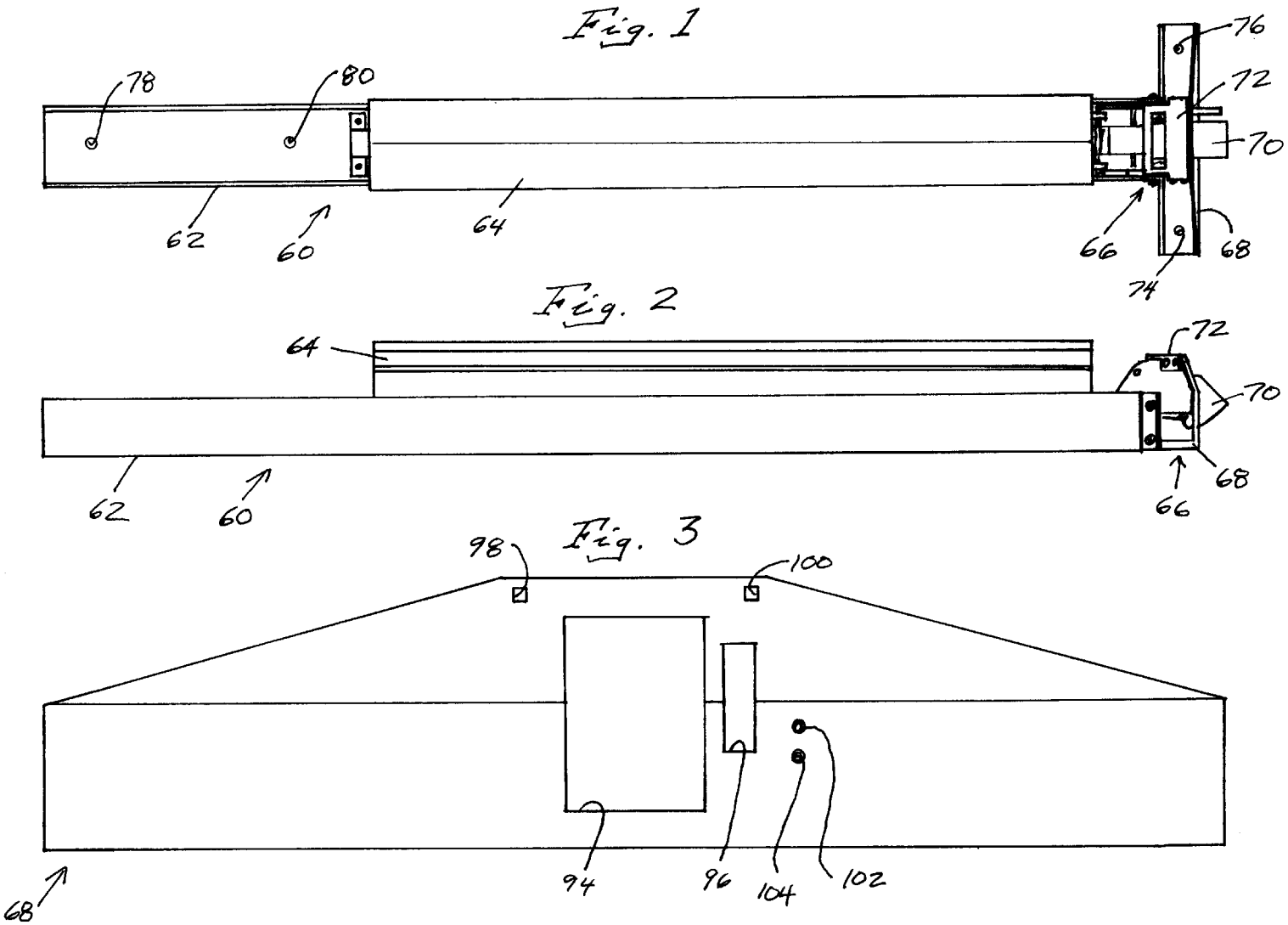
FIG. 1 is a top plan view of the door access locking bar of the present invention, showing a pressure bar mounted on a base rail, and also showing a latching mechanism mounted at one end of the base rail.
FIG. 2 is a side plan view of the door access locking bar illustrated in FIG. 1, showing the bolt as it extends out of the latching mechanism.
FIG. 3 is an end plan view of a latching mechanism support member which is located at one end of the support rail of the door access locking bar illustrated in FIGS. 1 and 2.

The preferred embodiment of the door access locking bar of the present invention is illustrated in FIGS. 1 and 2, which depict an assembled door access locking bar 60 as it appears when mounted on a door (not illustrated herein). Three of the five main components of the door access locking bar 60 are illustrated at least in part in FIGS. 1 and 2. The frame of the door access locking bar 60 is a base rail 62 upon which the other components of the door access locking bar 60 are mounted. Mounted on the top side of the base rail 62 (the side facing away from a door on which the door access locking bar 60 is mounted) is a pressure bar 64. The pressure bar 64 is moveable between a first position which is relatively away from the base rail 62 and a second position which is relatively toward the base rail 62.

Located at one end of the base rail 62 is the latching mechanism which is generally indicated with the reference numeral 66. The most visible components of the latching mechanism 66 are a latching mechanism support member 68, a bolt 70, and a cover member 72. The latching mechanism support member 68 forms the crossbar of a T in which the base rail 62 is the base of the T. Two apertures 74 and 76 which are located in the bottom of the latching mechanism support member 68 near the opposite ends thereof may be used to mount the door access locking bar 60 to a door (not illustrated herein). Two additional apertures also for use in mounting the door access locking bar 60 are illustrated in the base rail 62.

The first major component of the door access locking bar 60 to be discussed will be the latching mechanism 66, which will be discussed in FIGS. 3 through 19. Referring first to FIGS. 3 through 6, the latching mechanism support member 68 is illustrated. As best evident in FIGS. 5 and 6, the latching mechanism support member 68 is generally of a U-shaped configuration. The side of the U of the latching mechanism support member 68 which is adjacent to the base rail 62 (illustrated in FIGS. 1 and 2) is open, with rectangular flanges 82 and 84 located on opposite sides of this opening.

Figure 4:
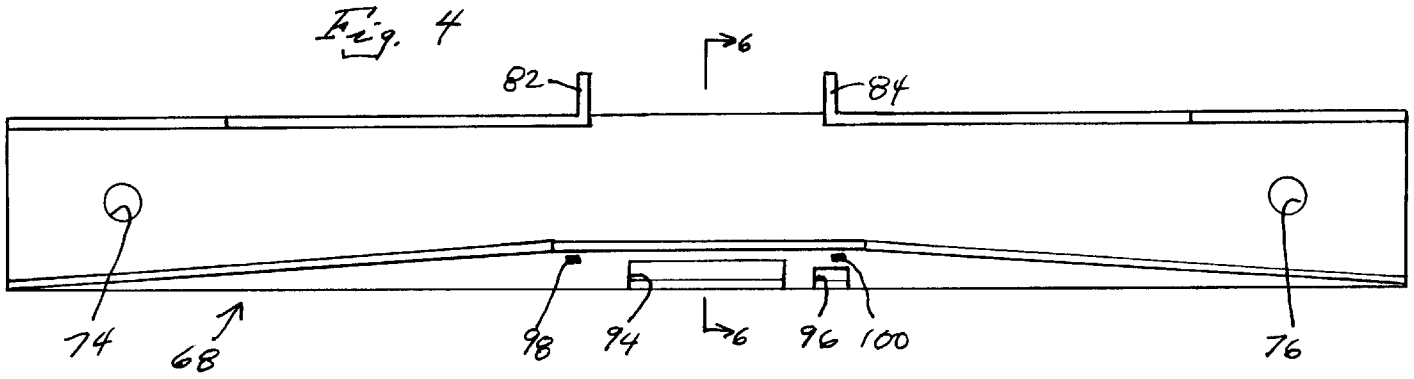
FIG. 4 is a top plan view of the latching mechanism support member illustrated in FIG. 3, showing the interior thereof; 1
Figure 5:
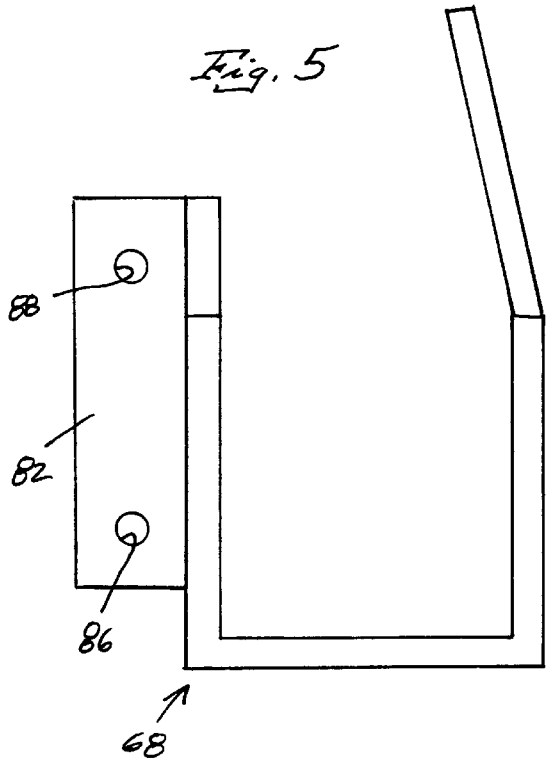
FIG. 5 is a side plan view of the latching mechanism support member illustrated in FIGS. 3 and 4, showing the general configuration thereof.
Figure 6:
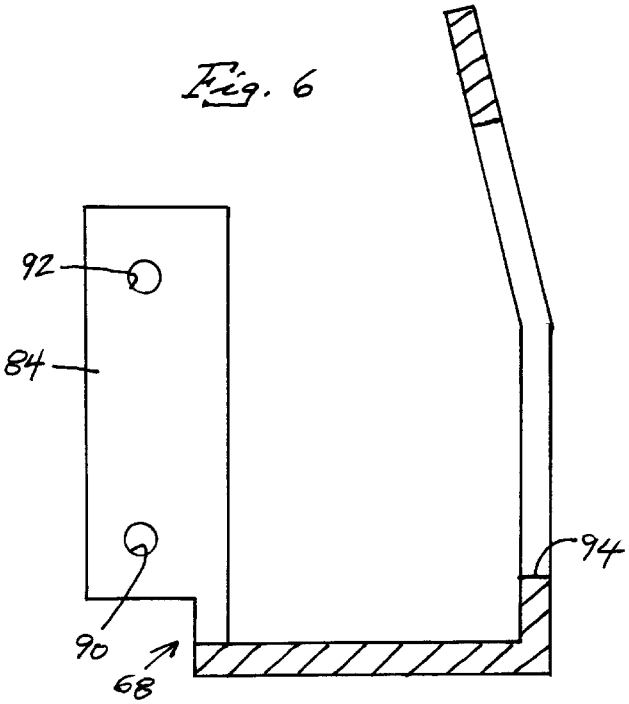
FIG. 6 is a cross-sectional view of the latching mechanism sup pt member illustrated in FIGS. 3 through 5.

As best illustrated in FIGS. 5 and 6, a pair of apertures 86 and 88 are located in the flange 82, and a pair of apertures 90 and 92 are located in the flange 84. As best illustrated in FIGS. 3 and 4, centrally located in the side of the U of the latching mechanism support member 68 opposite the opening surrounded by the flanges 82 and 84 is a large rectangular aperture 94 through which the bolt 70 (illustrated in FIGS. 1 and 2) will extend. Located to one side of the rectangular aperture 94 is a smaller rectangular aperture 96 through which a component used in the interlock mechanism will extend.

Located on opposite sides of the rectangular aperture 94 in the same side of the latching mechanism support member 68 and near the top edge thereof are two rectangular apertures 98 and 100. Two small countersunk apertures 102 and 104 are located in the latching mechanism support member 68 near the side of the rectangular aperture 96 which is opposite the rectangular aperture 94.

Figure 7:
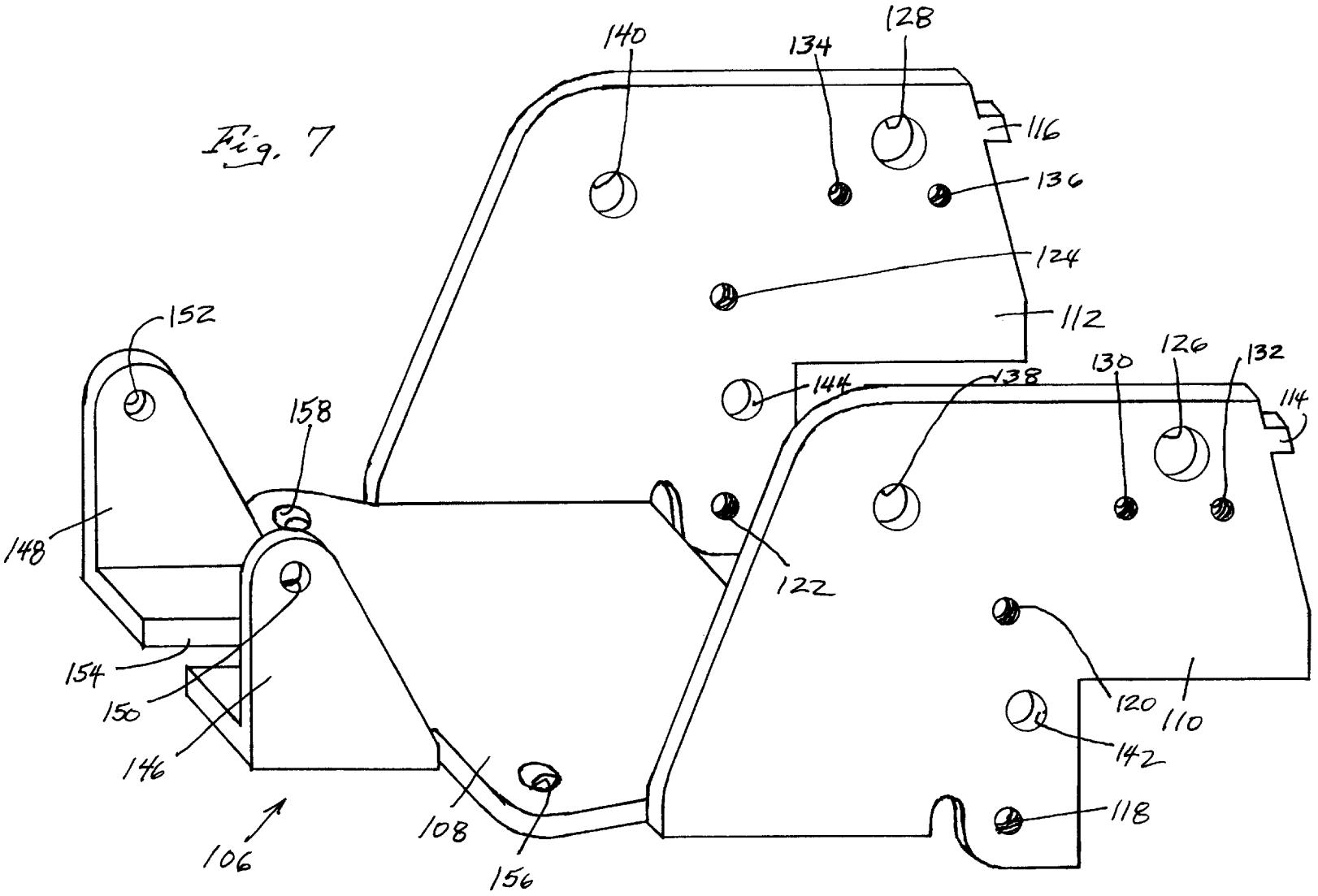
FIG. 7 is an isometric view of a latching mechanism housing member for installation onto the latching mechanism support member illustrated in FIGS. 3 through 6.

Referring next to FIG. 7, a latching mechanism housing member 106 for installation onto the latching mechanism support member 68 illustrated in FIGS. 3 through 6 is shown. The latching mechanism housing member 106 has a base member 108 having a wider portion and a narrower portion. Extending upwardly from the wider portion of the base member 108 of the latching mechanism housing member 106 are two side plates 110 and 112. The side plates 110 and 112 have their lower right corners (as illustrated in FIG. 7) cut out.

Located on the right side of the side plate 110 is a rectangular projection 114 which extends outwardly therefrom. Similarly, located on the right side of the side plate 112 is a the rectangular projection 116 which extends outwardly therefrom. The rectangular projections 114 and 116 will be received in the rectangular apertures 98 and 100, respectively, in the latching mechanism support member 68 (illustrated in FIGS. 3 and 4).

Located in the side plate 110 are two threaded apertures 118 and 120, which will be aligned with the apertures 86 and 88 in the flange 82 of the latching mechanism support member 68 (illustrated in FIG. 5). Similarly, located in the side plate 112 are two threaded apertures 122 and 124, which will be aligned with the apertures 90 and 92 in the flange 84 of the latching mechanism support member 68 (illustrated in FIG. 6).

Located in the side plate 110 near the upper edge at the right side thereof (as illustrated in FIG. 7) is an aperture 126. Similarly, located in the side plate 112 near the upper edge at the right side thereof (as illustrated in FIG. 7) is an aperture 128. The apertures 126 and 128 define an axis around which the bolt 70 (illustrated in FIGS. 1 and 2) will pivot. Located in the side plate 110 below and on opposite sides of the aperture 126 are two threaded apertures 130 and 132. Similarly, located in the side plate 112 below and on opposite sides of the aperture 128 are two threaded apertures 134 and 136.

Located in the upper left quarter of the side plate 110 (as illustrated in FIG. 7) is an aperture 138. Similarly, located in the upper left quarter of the side plate 112 (as illustrated in FIG. 7) is an aperture 140. The apertures 138 and 140 define an axis around which the drive arm (not illustrated in FIG. 7) which operates the bolt 70 (illustrated in FIGS. 1 and 2) will pivot.

Located in the side plate 110 intermediate the threaded apertures 118 and 120 is an aperture 142. Similarly, located in the side plate 112 intermediate the threaded apertures 122 and 124 is an aperture 144. The apertures 142 and 144 define an axis around which part of the interlock mechanism (not illustrated in FIG. 7) will pivot.

Extending upwardly from the narrower portion of the base member 108 of the latching mechanism housing member 106 are two support members 146 and 148. Located near the top of the support member 146 is an aperture 150. Similarly, located near the top of the support member 148 is an aperture 152. The apertures 150 and 152 define an axis around which part of the locking mechanism (not illustrated in FIG. 7) will pivot.

Extending part way through the base member 108 intermediate the support members 146 and 148 is a slot 154 through which part of the locking mechanism will extend. Located on opposite sides of the wider portion of the base member 108 are two apertures 156 and 158, which will be used to mount the latching mechanism housing member 106 into the base rail 62 (illustrated in FIGS. 1 and 2).

Figure 8:
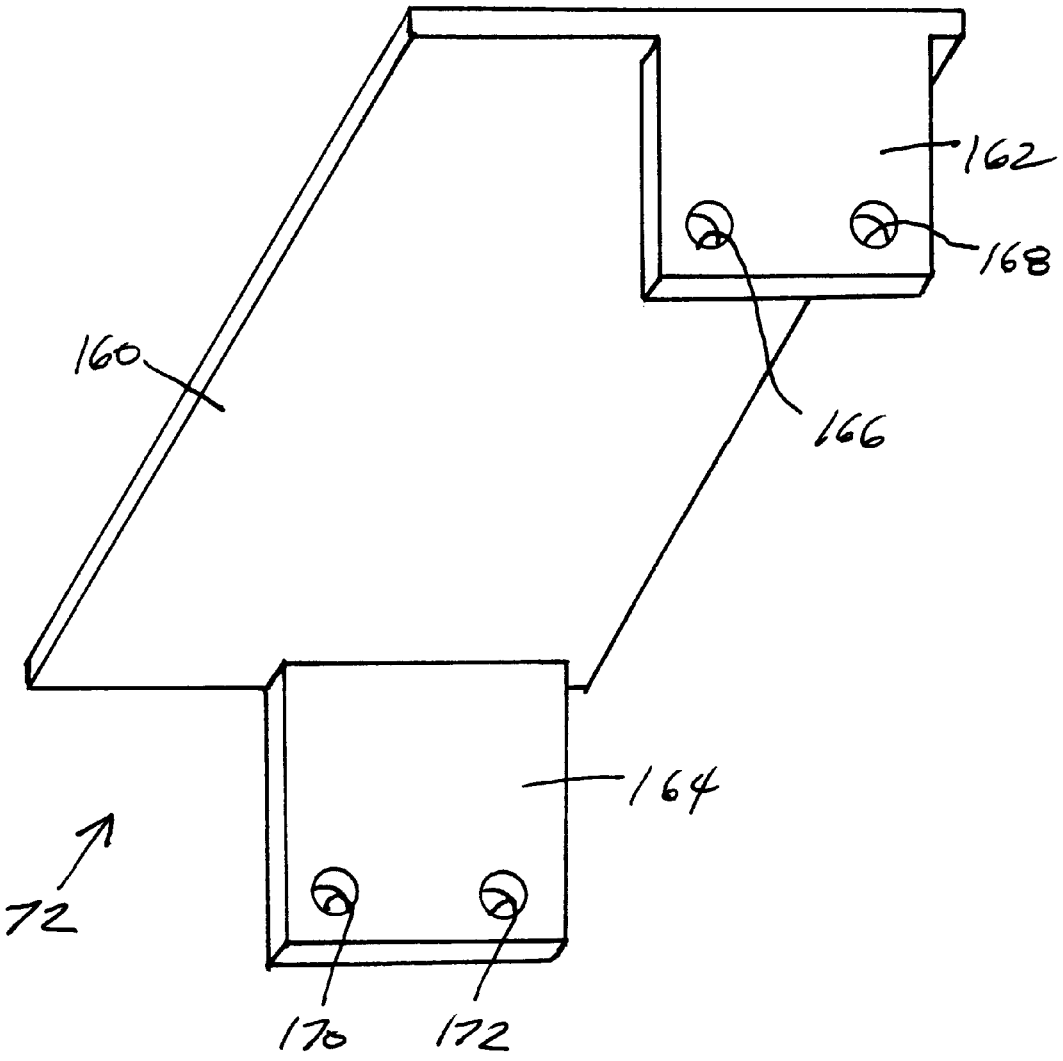
FIG. 8 is an isometric view of a cover member for installation onto the latching mechanism housing member illustrated in FIG. 7.

Referring next to FIG. 8, the cover member 72 is illustrated to comprise a top plate 160 having two rectangular flanges 162 and 164 extending downwardly therefrom on opposite sides thereof. Located on opposite sides of the rectangular flange 162 adjacent the bottom edge thereof are two apertures 166 and 168. Similarly, located on opposite sides of the rectangular flange 164 adjacent the bottom edge thereof are two apertures 170 and 172.

The cover member 72 may be installed on the latching mechanism housing member 106 (illustrated in FIG. 7) using four bolts (not illustrated in FIG. 8) which extend through the apertures 166, 168, 170, and 172 in the cover member 72 and into the 130, 132, 134, and 136 in the latching mechanism housing member 106, respectively. When so installed, the rectangular flanges 162 and 164 of the cover member 72 will overly the side plates 110 and 112 of the latching mechanism housing member 106, respectively.

Referring now to FIGS. 9 through 16, the various components of the latching mechanism 66 and their construction together are illustrated. The latching mechanism housing member 106 is assembled to the latching mechanism support member 68 by inserting the rectangular projections 114 and 116 of the latching mechanism housing member 106 into the rectangular apertures 98 and 100 of the latching mechanism support member 68, respectively. Four screws 174 are inserted through the apertures 86, 88, 90, and 92 in the latching mechanism support member 68 and are then screwed into the threaded apertures 118, 120, 122, and 124 of the latching mechanism housing member 106, respectively.

Figure 10:
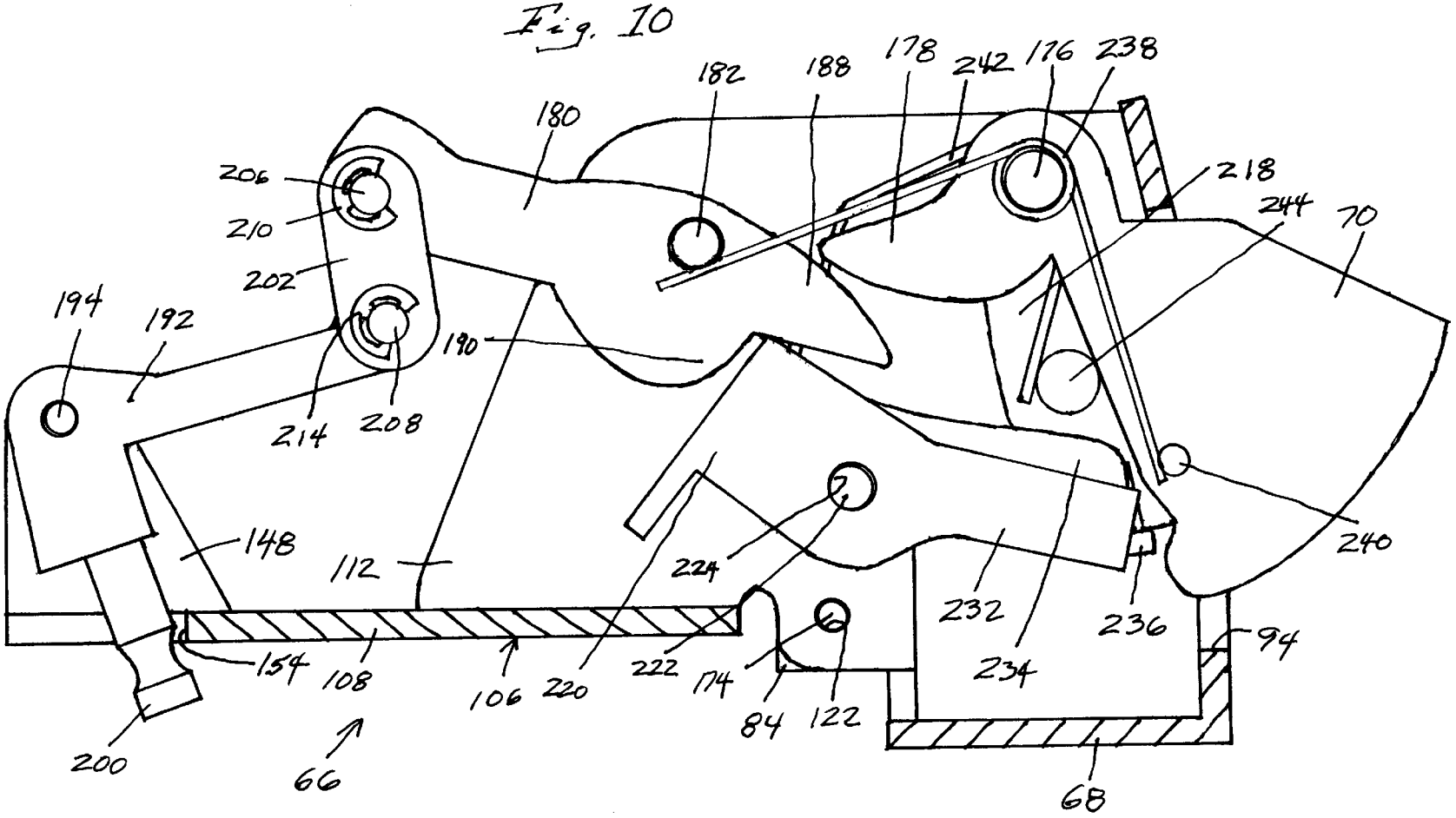
FIG. 10 is a side view of the assembly illustrated in FIG. 9 from one side thereof, with the latching mechanism housing member illustrated in FIG. 7 and the latching mechanism support member illustrated in FIGS. 3 through 6 cut away for clarity, showing the components as they would be with the pressure bar illustrated in FIGS. 1 and 2 in a first undepressed position.

The bolt 70 is pivotally mounted on a shaft 176 which extends through the apertures 126 and 128 (illustrated in FIG. 7) in the latching mechanism housing member 106. The shaft 176 is retained in place by the cover member 72 (illustrated in FIG. 8). The configuration of the bolt 70 is best shown in FIG. 10, where it may be seen that the portion of the bolt 70 extending from the latching mechanism support member 68 is essentially wedge-shaped, with the portion furthest from the shaft 176 defining an arc. The bolt 70 has a camming portion 178 which is used to drive the bolt 70 from its first extended position (illustrated in FIG. 10) into its second retracted position (illustrated in FIG. 11).

Figure 9:
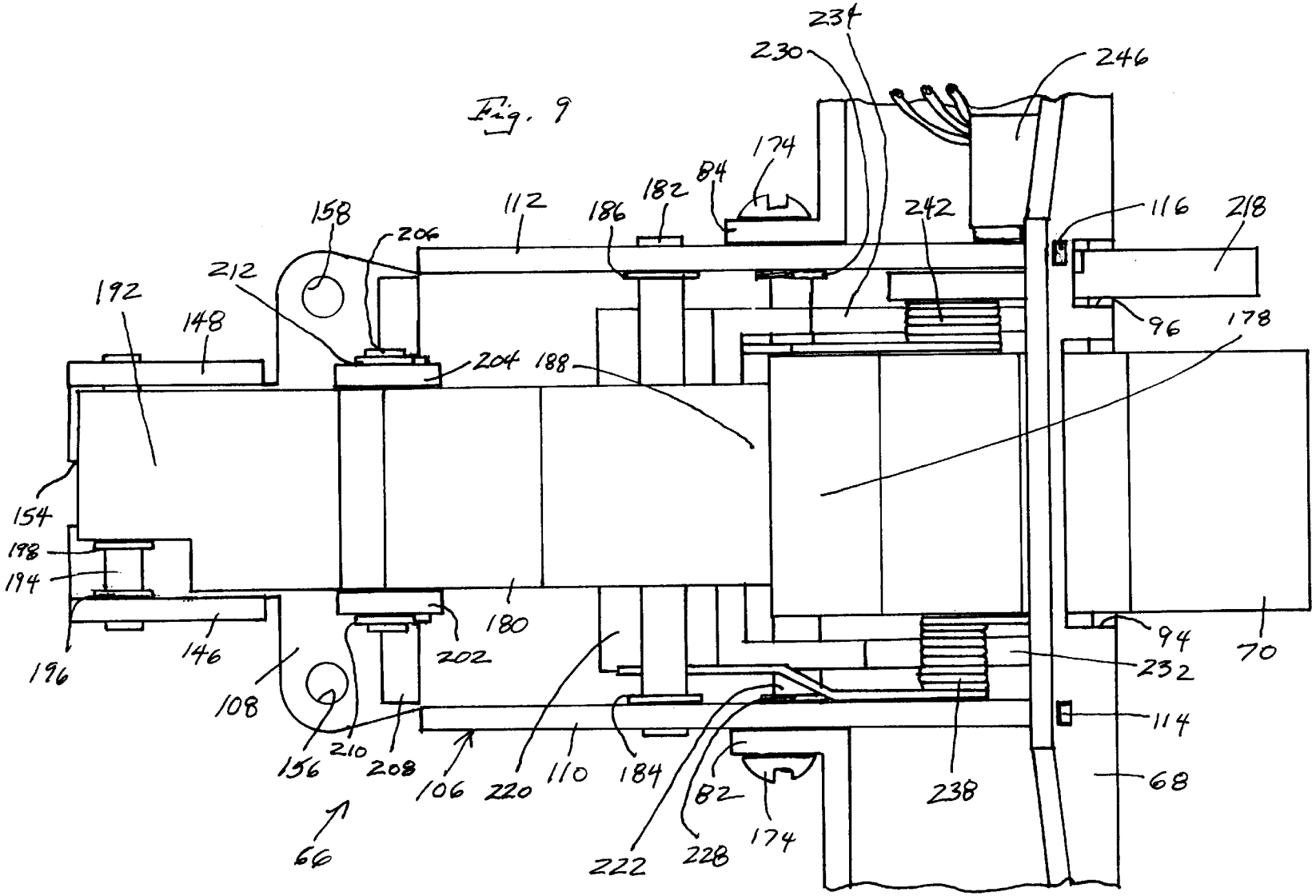
FIG. 9 is a top plan view of the various components of the latching mechanism assembled into the latching mechanism housing member illustrated in FIG. 7 and the latching mechanism support member illustrated in FIGS. 3 through 6 (the latter of which is shown only in part)

The bolt 70 is driven from its first extended position :to its second retracted position by a drive arm 180 which pivots on a shaft 182 which extends through the apertures 138 and 140 (illustrated in FIG. 7) in the latching mechanism housing member 106. The shaft 182 is retained in place by two C clips 184 and 186, which are installed into annular slots (not illustrated herein) located in the surface of the shaft 182 just inside the side plate 110 and the side plate 112, respectively, as shown in FIG. 9. The drive arm 180 pivots between a first position illustrated in FIG. 10 and a second position illustrated in FIG. 11.

The drive arm 180 has a first camming surface 188 located on the end portion thereof adjacent the camming portion 178 of the bolt 70. This first camming surface 188 of the drive arm 180 contacts and drives the camming portion 178 of the bolt 70. The drive arm 180 also has a second camming surface 190 located on the bottom side thereof which operates part of the interlock mechanism, as will become apparent below. The end of the drive arm 180 opposite the first camming surface 188 of the drive arm 180 has an aperture (not illustrated herein) which extends therethrough, and it is this end of the drive arm 180 which drives the movement of the drive arm 180 from its first position to its second position.

An L-shaped arm 192 is pivotally mounted on a shaft 194 which extends through the L-shaped arm 192 at the intersection of the base and the leg of the L. The shaft 194 extends through the apertures 150 and 152 (illustrated in FIG. 7) in the support members 146 and 148, respectively, of the latching mechanism housing member 106. The portion of the L-shaped arm 192 located intermediate the support members 146 and 148 as well as the base of the L of the L-shaped arm 192 is narrower than the leg of the L of the L-shaped arm 192, as best shown in FIG. 9. Two C clips 196 and 198 are installed into spaced-apart annular slots (not illustrated herein) located in the surface of the shaft 194.

Figure 11:
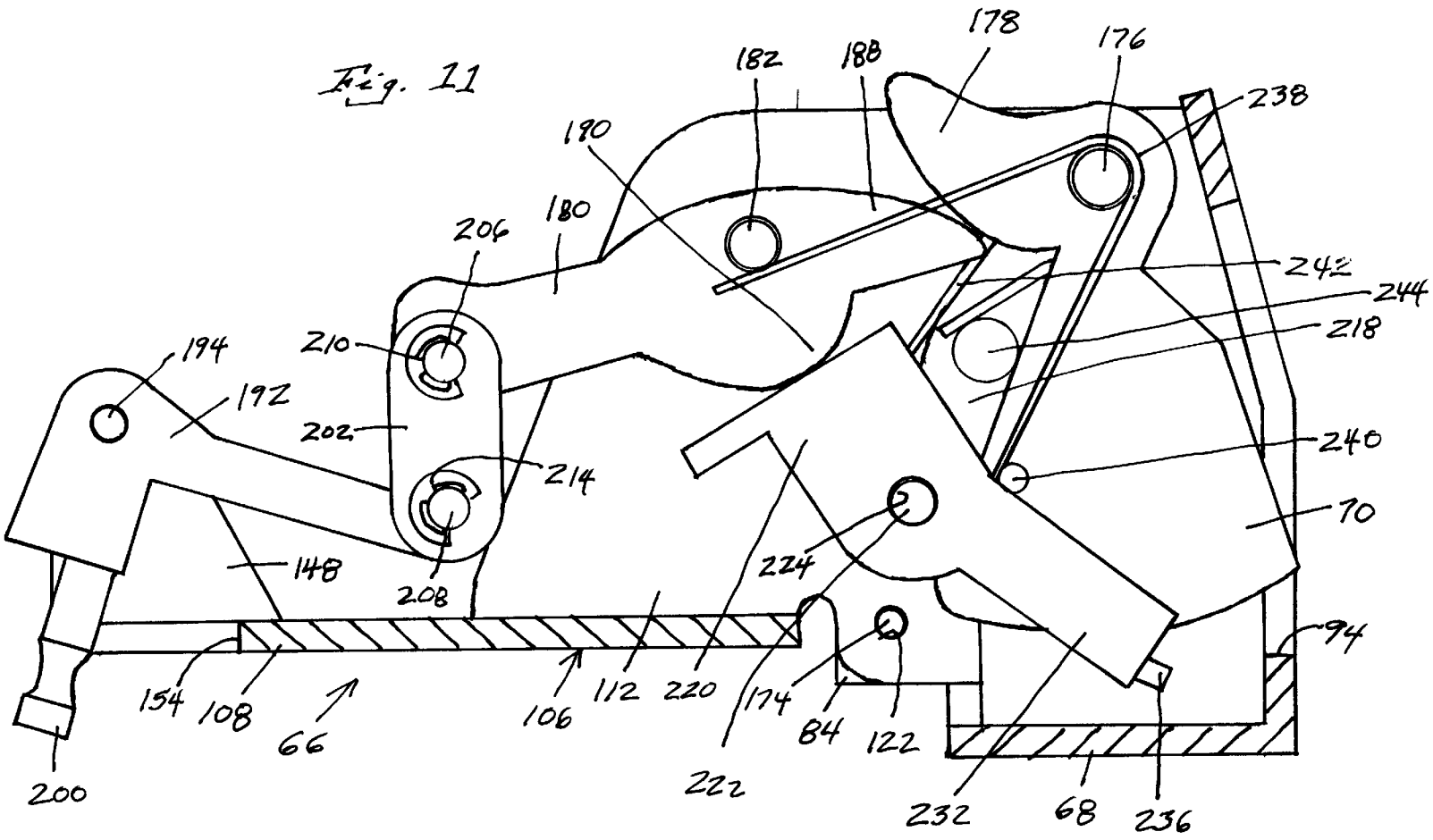
FIG. 11 is a side view similar to that illustrated in FIG. 10, showing the components as they would be with the pressure bar illustrated in FIGS. 1 and 2 in a second depressed position.

Extending from the end of the base of the L of the L-shaped arm 192 is a pivoting pin 200 which moves between a first position shown in FIG. 10 and a second position shown in FIG. 11. The pivoting pin 200 extends downwardly through the slot 154 in the base member 108 of the latching mechanism housing member 106. The end of the leg of the L of the L-shaped arm 192 has an aperture (not illustrated herein) which extends therethrough, and it is this end of the L-shaped arm 192 which drives the movement of the pivoting pin 200 from its first position to its second position.

The drive arm 180 and the L-shaped arm 192 are linked together by two link members 202 and 204, each of which have an aperture located at each end thereof (not illustrated herein). Two shafts 206 and 208 are used to connect the drive arm 180 and the L-shaped arm 192 to the link members 202 and 204. The shaft 206 extends sequentially through the aperture at one end of the link member 202, the aperture at the end of the drive arm 180, and the aperture at one end of the link member 204. The shaft 206 is retained in place by two C clips 210 and 212 which are installed into annular slots (not illustrated herein) located in the surface of the shaft 206 near the ends thereof.

Similarly, the shaft 208 extends sequentially through the aperture at the other end of the link member 202, the aperture at the end of the leg of the L of the L-shaped arm 192, and the aperture at the other end of the link member 204. The shaft 208 is retained in place by two C clips 214 and 216 which are installed into annular slots (not illustrated herein) located in the surface of the shaft 208. The shaft 208 is longer than the shaft 206, and both ends of the shaft 208 extend well beyond the C clips 214 and 216. The shaft 208 will be driven toward the base member 108 of the latching mechanism housing member 106 to operate the latching mechanism, as will become evident later.

The latching mechanism 66 illustrated in FIGS. 9 through 16 also includes an interlock mechanism. One of the components of this interlock mechanism is a cam member 218, which is also pivotally mounted on the shaft 176. The cam member 218 extends through the rectangular aperture 96 in the latching mechanism support member 68, and moves between a first extended position shown in FIG. 12 and a second retracted position shown in FIGS. 13 through 16. When the door that the door access locking bar 60 (illustrated in FIGS. 1 and 2) is mounted on is open, the cam member 218 will be in its first position. When the door is closed, the cam member 218 will be driven into its second position.

The surface of the cam member 218 furthest from the shaft 176 is a camming surface which operates a second component of the interlocking mechanism, a interlock member 220. The interlock member 220 is a U-shaped element which is pivotally mounted on a shaft 222 which extends through two apertures 224 and 226 in the legs of the interlock member 220. The shaft 222 extends through the apertures 142 and 144 in the latching mechanism housing member 106. The shaft 222 is retained in place by two C clips 228 and 230, which are installed into annular slots (not illustrated herein) located in the surface of the shaft 222 just inside the side plate 110 and the side plate 112, respectively, as shown in FIG. 9.

The arms of the interlock member 220 are sufficiently wide so that the bolt 70 fits between them as it is retracted, as best shown in the top view of FIG. 9. One arm 232 of the interlock member 220 is located on the side of the bolt 70 furthest away from the cam member 218, with the other arm 234 of the interlock member 220 being located intermediate the bolt 70 and the cam member 218. The arm 234 of the interlock member 220 has a flange 236 extending from the distal end thereof at the bottom thereof. The flange 236 extends outwardly away from the arm 232 of the interlock member 220. The camming surface of the interlock member 220 bears against the top surface of the flange 236 of the interlock member 220, as best shown in FIGS. 12 and 13.

Two springs are used in the latching mechanism 66. A spring 238 is used to bias the bolt 70 from its second retracted position toward its first extended position. A peg 240 extends from the side of the bolt 70 which faces away from the cam member 218, near the bottom thereof and on the portion of the bolt 70 which is furthest within the latching mechanism 66. The spring 238 is mounted on the shaft 176, and bears against the shaft 182 and the peg 240 on the bolt 70, thereby urging the bolt 70 from its second retracted position to its first extended position.

Another spring 242 is used to bias the cam member 218 from its second retracted position toward its first extended position, and also to bias the interlock member 220 to urge the distal ends of the arms 232 and 234 of the interlock member 220 upwardly. A peg 244 extends from the side of the cam member 218 which faces the bolt 70, near the bottom thereof and on the portion of the cam member 218 which is furthest within the latching mechanism 66. The spring 242 is also mounted on the shaft 176, and bears against the base of the U of the interlock member 220 and the peg 244 on the cam member 218, thereby urging the cam member 218 from its second retracted position to its first extended position.

Figure 12:
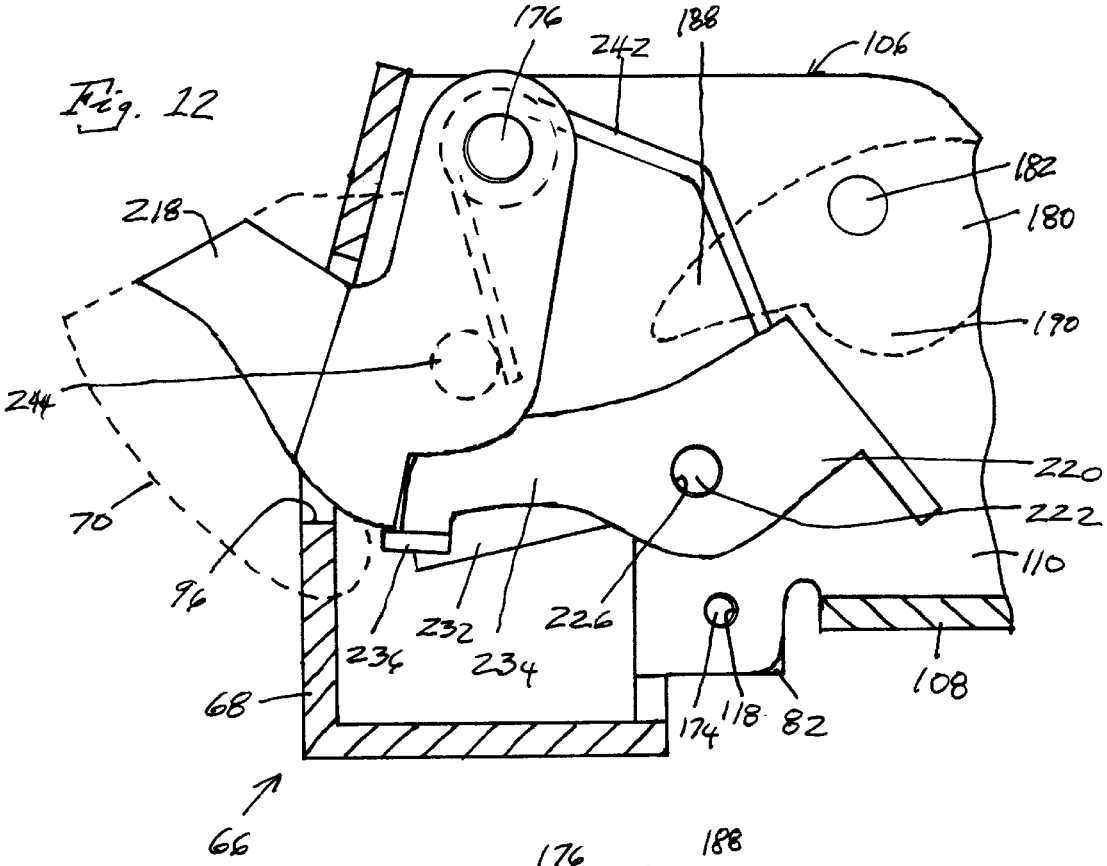
FIG. 12 is a side view of the assembly illustrated in FIG. 9 from the other side thereof, with the latching mechanism housing member illustrated in FIG. 7 and the latching mechanism support member illustrated in FIGS. 3 through 6 cut away for clarity, and with several other components shown in phantom lines, showing the components as they would be with the pressure bar illustrated in FIGS. 1 and 2 in the first undepressed position and with the door (not illustrated herein) open.
Figure 13:
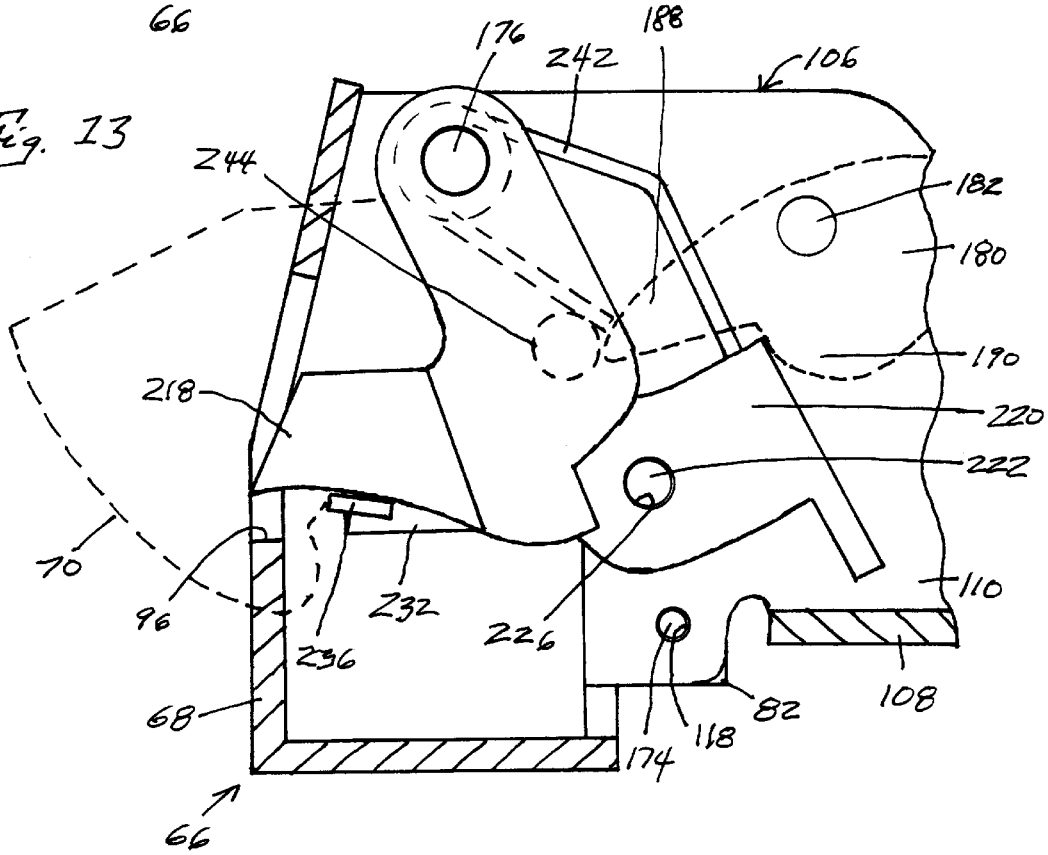
FIG. 13 is a side view similar to that illustrated in FIG. 12, showing the components as they would be with the pressure bar illustrated in FIGS. 1 and 2 in the first undepressed position and with the door (not illustrated herein) open.

As the cam member 218 pivots from its first extended position to its second retracted position as shown in FIGS. 12 and 13, the flange 236 on the arm 234 of the interlock member 220 will follow the camming surface of the cam member 218. The distal ends of the arms 232 and 234 of the interlock member 220 will move upwardly as the cam member 218 pivots from its first extended position to its second retracted position. When the arm 232 of the interlock member 220 is in this position, as shown in FIGS. and 14, the distal end of the arm 232 of the interlock member 220 will block the peg 240 from passing thereby. This prevents the bolt 70 from being forced into the latching mechanism 66 once the door (not illustrated herein) upon which the latching mechanism 66 is mounted has been closed. Note that until the door is closed, the cam member 218 will be extended as shown in FIG. 12, bearing against the flange 236 of the interlock member 220 and keeping the arm 232 of the interlock member 220 in its downward position such that the arm 234 of the interlock member 220 will not interfere with the movement of the peg 240 on the bolt 70.

Figure 14:
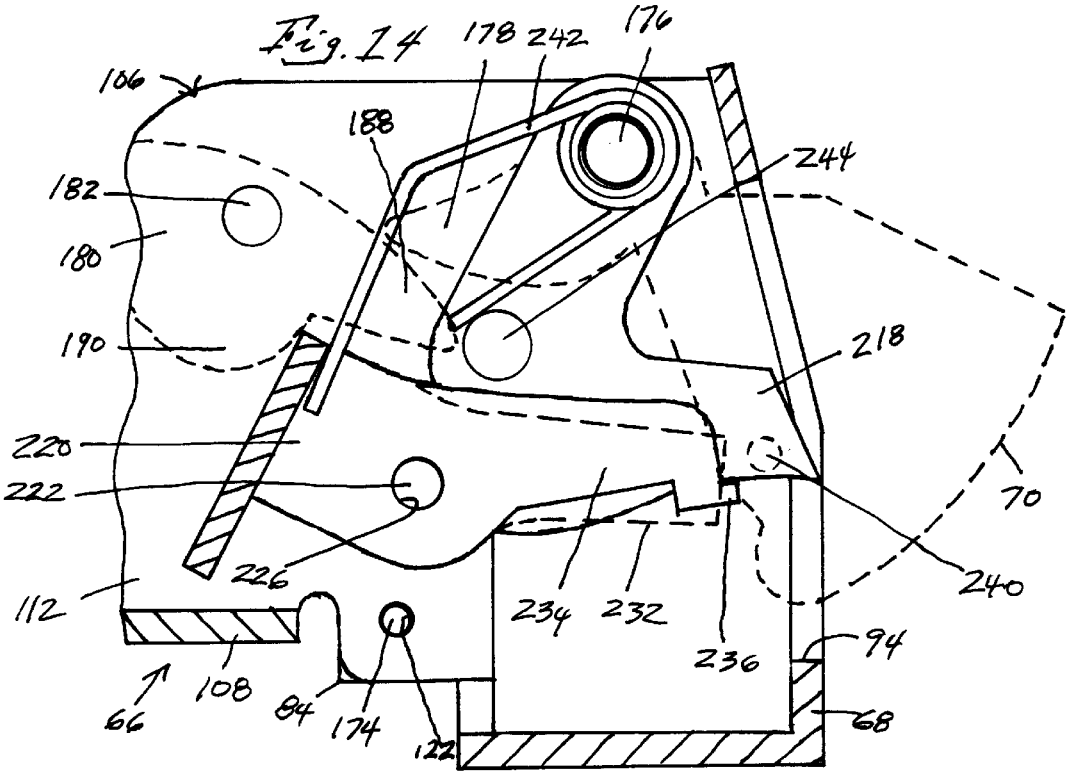
FIG. 14 is a side view similar to that illustrated in FIG. 10, but with several other components shown in phantom lines, showing the components as they would be with the pressure bar and the latching mechanism as they are in FIG. 13.

With the interlock member 220 in the position shown in FIGS. 13 and 14, when the drive arm 180 begins to pivot from its first position to its second position, the second camming surface 190 of the drive arm 180 will contact the interlock member 220 at the base of the U of the interlock member 220. This occurs before the first camming surface 188 of the drive arm 180 contacts the camming portion 178 of the bolt 70. As the second camming surface 190 of the drive arm 180 contacts the interlock member 220 at the base of the U of the interlock member 220, it drives the distal ends of the arms 232 and 234 of the interlock member 220 downwardly, removing the distal end of the arm 234 of the interlock member 220 from its blocking position adjacent the peg 240 on the bolt 70.

Figures 16, 17, 18, 19:
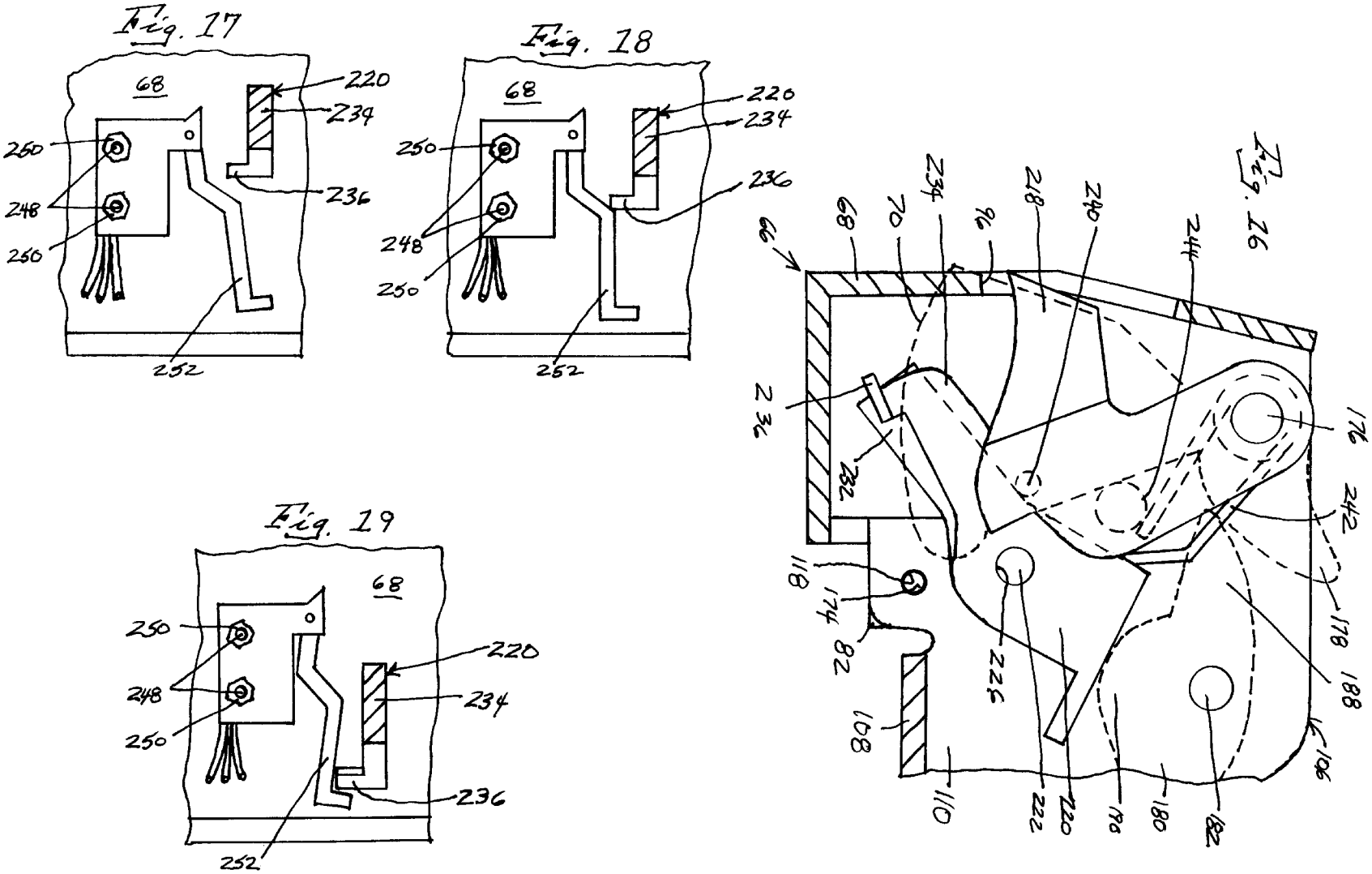
FIG. 16 is a side view similar to that illustrated in FIGS. 14 and 15, showing the components as they would be with the pressure bar illustrated in FIGS. 1 and 2 in the second depressed position.
FIG. 17 is a plan view of a microswitch mounted on the interior of the latching mechanism support member illustrated in FIGS. 3 through 6 which is actuated by a component of the latching mechanism best illustrated in FIGS. 12 through 16, with the arm of the microswitch in the position corresponding to the position of the latching mechanism illustrated in FIG. 13 and 14.
FIG. 18 is a plan view of the microswitch illustrated in FIG. 17, with the arm of the microswitch in the position corresponding to the two positions of the latching mechanism illustrated in FIG. 12 and 15.
FIG. 19 is a plan view of the microswitch illustrated in FIGS. 17 and 18, with the arm of the microswitch in the position corresponding to the position of the latching mechanism illustrated in FIG. 16.

As the first camming surface 188 of the drive arm 180 contacts the camming portion 178 of the bolt 70, it will drive the bolt 70 from its first extended position to its second retracted position. As the bolt 70 moves from its first extended position into its second retracted position, the peg 240 on the bolt 70 will contact the top surface of the arm 232 of the interlock member 220, urging the arms 232 and 234 of the interlock member 220 fully downward, as shown in FIGS. 11 and 16. In this position, the flange 236 on the arm 234 of the interlock member 220 is in its fully downward position.

This is important to note since the flange 236 on the arm 234 of the interlock member 220 operates a microswitch 246 shown in FIG. 9 as well as in FIGS. 17 through 19. The microswitch 246 is mounted onto the latching mechanism support member 68 using two flat head bolts 248 which extend through the countersunk apertures 102 and 104 (illustrated in FIG. 3) in the latching mechanism support member 68 and two apertures (not illustrated herein) which extend through the microswitch 246. Two nuts 250 are then mounted on the two flat head bolts 248.

An arm 252 of the microswitch 246 has an irregular surface, such that as the flange 236 on the arm 234 of the interlock member 220 moves it will cause the arm 234 of the interlock member 220 to have three positions: a first position when the flange 236 on the arm 234 of the interlock member 220 is not contacting the arm 252 of the microswitch 246 (as shown in FIGS. 13 and 14); a second position when the flange 236 on the arm 234 of the interlock member 220 is in its intermediate position (as shown in FIGS. 10 and 12, and also in FIG. 15); and a third position when the flange 236 on the arm 234 of the interlock member 220 is in its fully downward position (as shown in FIGS. 11 and 16).

Figure 15:
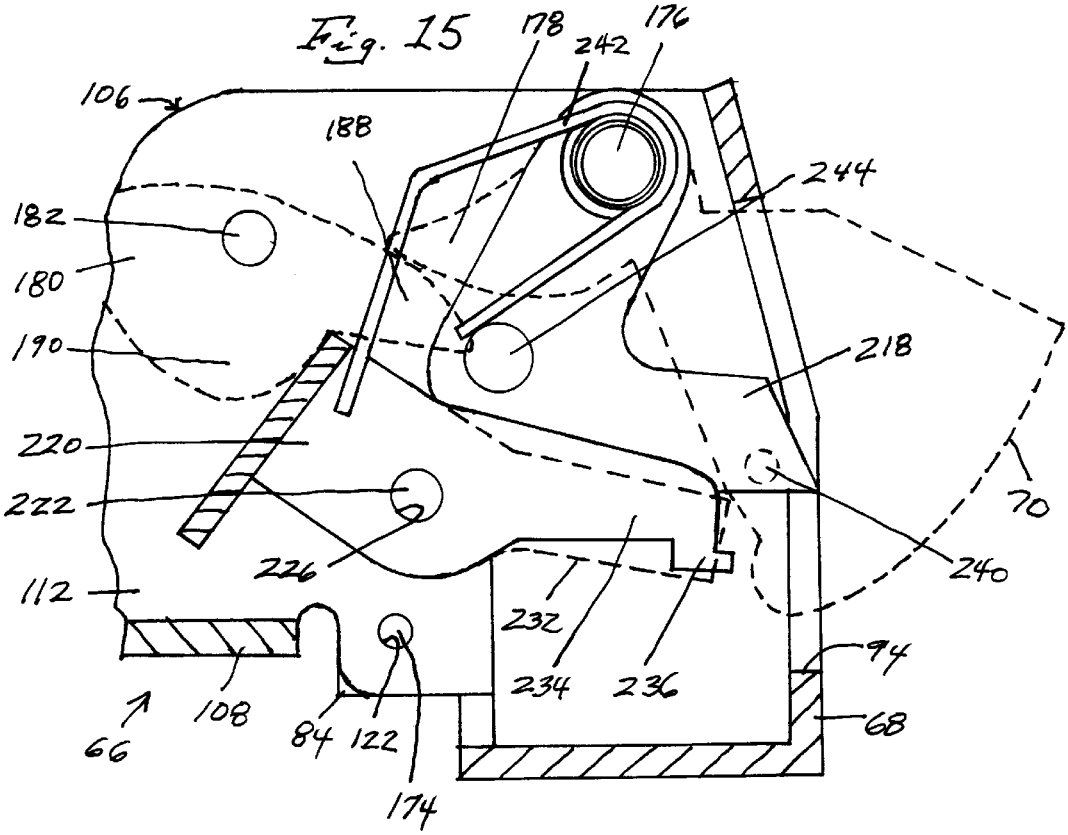
FIG. 15 is a side view similar to that illustrated in FIG. 14, showing the components as they would be with the pressure bar illustrated in FIGS. 1 and 2 moved slightly from the first undepressed position toward the second depressed position.

Thus, the microswitch 246 will serve to provide information about the status of the door (not illustrated herein) at all times. When the door is open, the microswitch 246 will be in its second position. When the door is closed, the microswitch 246 will be in its first position. When the shaft 208 (illustrated in FIGS. 9 and 10) is depressed, indicating that access or egress is desired, the drive arm 180 will begin to pivot from its first position toward its second position, as shown in FIG. 15. The second camming surface 190 of the drive arm 180 will drive the interlock member 220 to move such that the microswitch 246 will again be in its second position.

When access is allowed, the drive arm 180 will move from its first position to its second position, causing the bolt 70 to move from its first extended position to its second retracted position, as shown in FIGS. 11 and 16. In this position, the microswitch 246 will be in its third position as the door (not illustrated herein) is opened, until pressure on the shaft 208 (illustrated in FIGS. 9 and 10) is released, allowing the drive arm 180 to pivot from its second position to its first position, as shown in FIGS. 9, 10, and 12, at which time the microswitch 246 will return to its second position.

Figures 20, 22, 29, 30, 34:
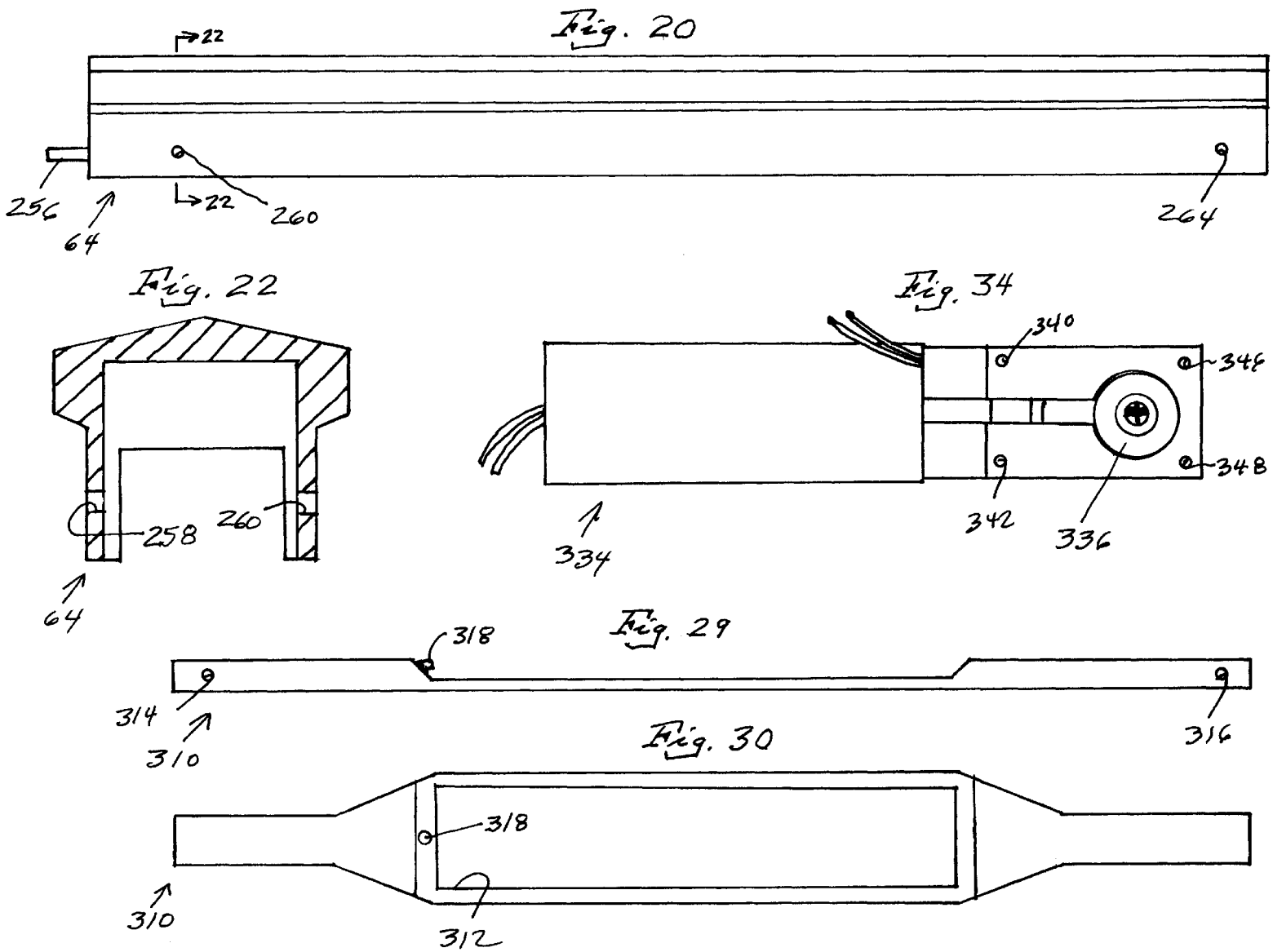
FIG. 20 is a side plan view of the pressure bar illustrated in FIGS. 1 and 2, showing a pin extending from one end of the pressure bar and the location of apertures located in the sides of the pressure bar.
FIG. 22 is a cross-sectional view of the pressure bar illustrated in FIGS. 20 and 21, showing a pair of apertures located in opposite sides of the pressure bar.
FIG. 29 is a side plan view of a linking member showing the locations of apertures in the ends of the linking member.
FIG. 30 is a top plan view of the linking member illustrated in FIG. 29, showing the hollow configuration of the intermediate portion of the linking member.
FIG. 34 is a bottom plan view of the solenoid actuator illustrated in FIG. 33, showing threaded apertures which may be used to mount the solenoid actuator.
Figure 21:
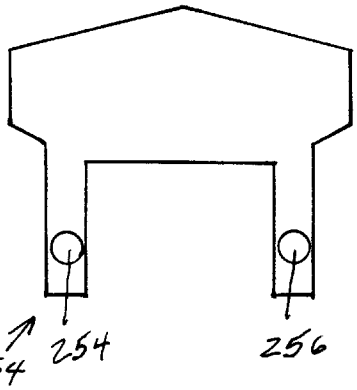
FIG. 21 is an end view of the pressure bar illustrated in FIG. 20, showing the locations of two pins extending from the end of the pressure bar.

FIGS. 20 through 22 show the pressure bar 64 illustrated in FIGS. 1 and 2 in greater detail. As best shown in FIGS. 21 and 22, the pressure bar 64 is hollow inside, and is completely open at the bottom side thereof (the side which will fit into the base rail 62 illustrated in FIGS. 1 and 2). The pressure bar 64 has two pins 254 and 256 extending from one end thereof on opposite sides thereof. The end of the pressure bar 64 on which the pins 254 and 256 are mounted is partially open, as best shown in FIG. 21.

The end of the pressure bar 64 on which the pins 254 and 256 are mounted will fit over a portion of the latching mechanism 66 (illustrated in FIGS. 9 and 10). The pins 254 and 256 will contact the ends of the shaft 208 (illustrated in FIGS. 9 and 10) of the latching mechanism 66. The pressure bar 64 is mounted in the base rail 62 (illustrated in FIGS. 1 and 2) for movement between two position relatively toward and away from the base rail 62. The pressure bar 64 has a first position which is relatively away from the base rail 62, and a second position which is relatively toward the base rail 62. As the pressure bar 64 moves from its first position to its second position, the pins 254 and 256 will press the shaft 208 of the latching mechanism 66 toward the base member 108, driving the drive arm 180 from its first position to its second position.

The pressure bar 64 has two pairs of apertures located in its side walls near the ends thereof. The first pair of apertures 258 and 260 are shown in FIG. 22, and the location of the second pair of apertures 262 and 264 are illustrated by the aperture 264 in FIG. 20.

Figure 23:
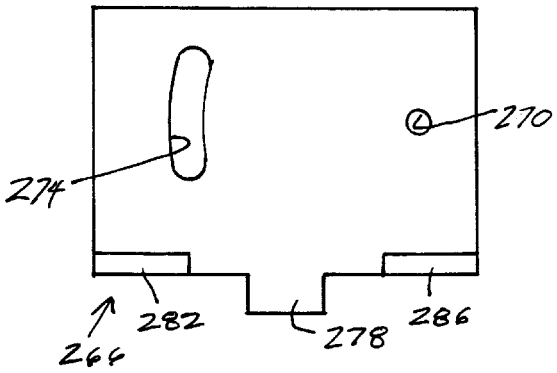
FIG. 23 is a side plan view of a U-shaped support member, showing the location of a slot and an aperture located in the U-shaped support member.
Figure 25:
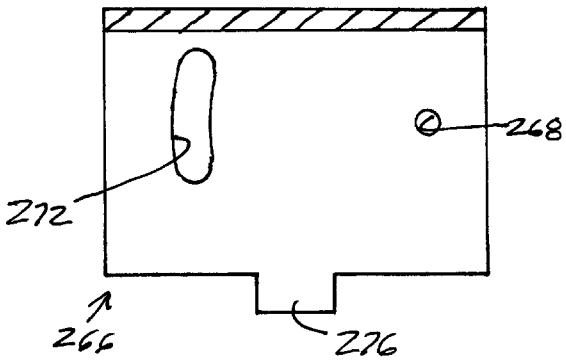
FIG. 25 is a cross-sectional view of the U-shaped support member illustrated in FIGS. 23 and 24, showing the location of another slot and another aperture located in the U-shaped support member.
Figure 24:
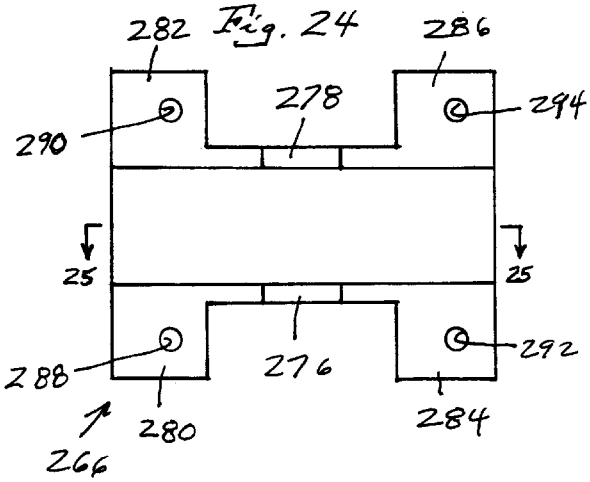
FIG. 24 is a bottom plan view of the U-shaped support member illustrated in FIG. 23, showing flanges extending from the sides of the U-shaped support member.

Referring next to FIGS. 23 through 25, a U-shaped support member 266 is illustrated which has a width (between the portions which define the legs of the U) to fit within the interior of the pressure bar 64 (illustrated in FIG. 22). The portions of the U-shaped support member 266 which define the legs of the U have corresponding apertures 268 and 270 centrally located therein the near one end thereof, as shown in FIGS. 24 and 25. The portions of the U-shaped support member 266 which define the legs of the U also have corresponding curved slots 272 and 274 centrally located therein the near one end thereof, as shown in FIGS. 24 and 25. The slots 272 and 274 have a radius of curvature which has as its point of origin the apertures 268 and 270, respectively.

The portions of the U-shaped support member 266 which define the ends of the legs of the U have centrally located tabs 276 and 278 extending therefrom. The portions of the U-shaped support member 266 which define the ends of the legs of the U also have flanges 280, 282, 284, and 286 extending outwardly therefrom at the ends of the legs of the U-shaped support member 266. The flanges 280, 282, 284, and 286 have threaded apertures 288, 290, 292, and 294, respectively, located therein.

Figure 26:
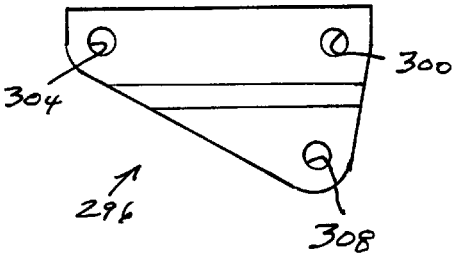
FIG. 26 is a side plan view of a U-shaped pivot member, showing the location of apertures in the U-shaped pivot member.
Figure 28:
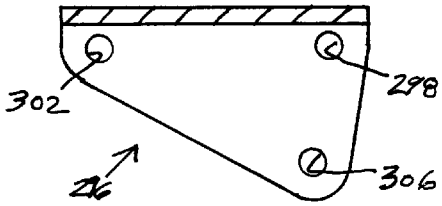
FIG. 28 is a cross-sectional view of the U-shaped pivot member illustrated in FIGS. 26 and 27, showing the location of more apertures in the U-shaped pivot member.
Figure 27:
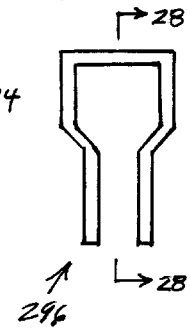
FIG. 27 is an end view of the U-shaped pivot member illustrated in FIG. 26, showing the configuration of the U-shaped pivot member.

Referring now to FIGS. 26 through 28, a U-shaped pivot member 296 is illustrated which is essentially U-shaped in cross section as best shown in FIG. 27, and in which the portions forming the legs of the U resemble right triangles as best shown in FIGS. 26 and 28. Note from FIG. 27 that the portions forming the legs of the U of the U-shaped pivot member 296 have portions adjacent the base of the U that are spaced wider apart than are the portions adjacent the tips of the legs of the U.

The U-shaped pivot member 296 has three pairs of corresponding apertures located in the portions forming the legs of the U. A first pair of corresponding apertures 298 and 300 are located in the portions of the U-shaped pivot member 296 forming the legs of the U adjacent the base of the U and at the right angle defining the right triangle configuration of the portions of the U-shaped pivot member 296 forming the legs of the U.

A second pair of corresponding apertures 302 and 304 are located in the portions of the U-shaped pivot member 296 forming the legs of the U adjacent the base of the U and at the end opposite the right angle defining the right triangle configuration of the portions of the U-shaped pivot member 296 forming the legs of the U. A third pair of corresponding apertures 306 and 308 are located in the portions of the U-shaped pivot member 296 forming the legs of the U adjacent the tip of the legs of the U and are aligned with the first pair of corresponding apertures 298 and 300.

Referring next to FIGS. 29 and 30, a linking member 310 is illustrated which has two end portions which are relatively narrow and a central portion which is wider, as shown in FIG. 30. The central portion of the linking member 310 has a large rectangular aperture 312 extending therethrough, as shown in FIG. 30. The linking member 310 has apertures 314 and 316 which extend therethrough near the ends thereof, as shown in FIG. 29. The linking member 310 also has a peg 318 extending therefrom adjacent the portion of the large rectangular aperture 312 closest to the end having the aperture 314 therein.

Figure 31:
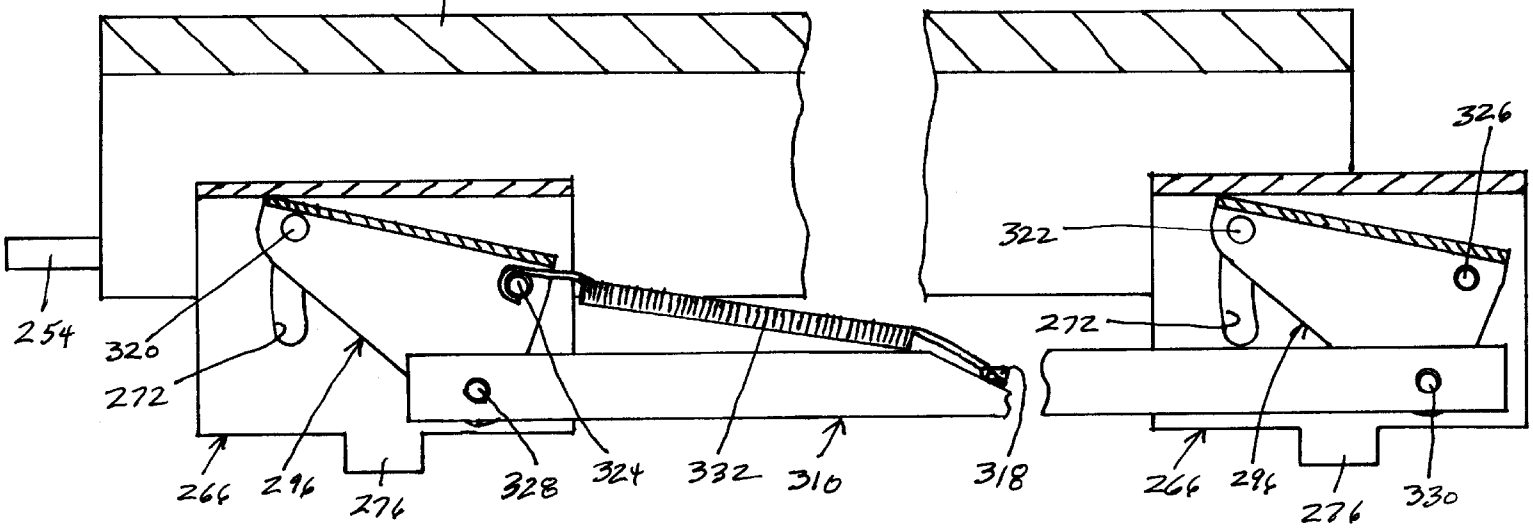
FIG. 31 is a partial cross sectional view showing the assembly of the U-shaped support members illustrated in FIGS. 23 through 25, the U-shaped pivot members illustrated in FIGS. 26 through 28, and the linking member illustrated in FIGS. 29 and 30 into the pressure bar illustrated in FIGS. 20 through 22, and also showing the installation of a spring, with the pressure bar shown in a first undepressed position into which it urged by the spring.
Figure 32:
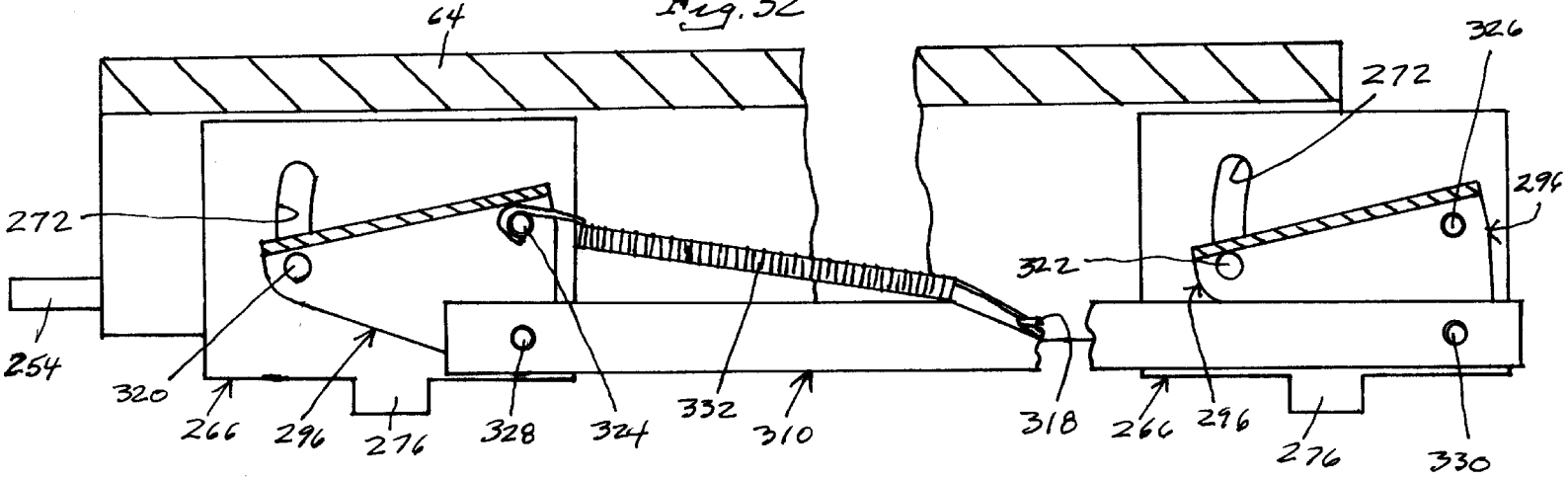
FIG. 32 is a view similar to that illustrated in FIG. 31, with the pressure bar shown in a second depressed position.

Referring now to FIGS. 31 and 32, with reference to FIGS. 20 through 30 as necessary for the location of the various apertures in the components, the construction and operation of the pressure bar assembly is illustrated. The pressure bar 64 is mounted to a first U-shaped support member 266 and a first U-shaped pivot member 296 with a pin 320. The pin 320 extends sequentially through the aperture 258 (FIGS. 20 and 22) in the pressure bar 64, the slot 272 (FIG. 23) in the first U-shaped support member 266, the aperture 302 (FIG. 26) in the first U-shaped pivot member 296, the aperture 304 (FIG. 28) in the first U-shaped pivot member 296, the slot 274 (FIG. 25) in the first U-shaped support member 266, and the aperture 260 (FIG. 22) in the pressure bar 64. The pin 320 has an interference fit in the apertures 258 and 260 in the pressure bar 64.

The pressure bar 64 is mounted to a second U-shaped support member 266 and a second U-shaped pivot member 296 with a pin 322. The pin 322 extends sequentially through the aperture 262 (FIG. 20) in the pressure bar 64, the slot 272 (FIG. 23) in the second U-shaped support member 266, the aperture 302 (FIG. 26) in the second U-shaped pivot member 296, the aperture 304 (FIG. 28) in the second U-shaped pivot member 296, the slot 274 (FIG. 25) in the second U-shaped support member 266, and the aperture 264 in the pressure bar 64. The pin 322 has an interference fit in the apertures 262 and 264 in the pressure bar 64.

The first U-shaped pivot member 296 is pivotally mounted in the first U-shaped support member 266 with a pin 324. The pin 324 extends sequentially through the aperture 268 in the first U-shaped support member 266, the aperture 298 in the first U-shaped pivot member 296, the aperture 300 in the first U-shaped pivot member 296, and the aperture 270 in the first U-shaped support member 266. The pin 324 has an interference fit in the apertures 268 and 270 in the first U-shaped support member 266.

The second U-shaped pivot member 296 is pivotally mounted in the second U-shaped support member 266 with a pin 326. The pin 326 extends sequentially through the aperture 268 in the second U-shaped support member 266, the aperture 298 in the second U-shaped pivot member 296, the aperture 300 in the second U-shaped pivot member 296, and the aperture 270 in the second U-shaped support member 266. The pin 326 has an interference fit in the apertures 268 and 270 in the second U-shaped support member 266.

The end of the linking member 310 in which the aperture 314 is located is pivotally mounted onto the first U-shaped pivot member 296 with a pin 328. The pin 328 extends sequentially through the aperture 306 (FIG. 28) in the first U-shaped pivot member 296, the aperture 314 (FIG. 29) of the linking member 310, and the aperture 308 (FIG. 26) of the first U-shaped pivot member 296. The pin 328 has an interference fit in the apertures 306 and 308 in the first U-shaped pivot member 296.

The end of the linking member 310 in which the aperture 316 is located is pivotally mounted onto the second U-shaped pivot member 296 with a pin 328. The pin 330 extends sequentially through the aperture 306 (FIG. 28) in the second U-shaped pivot member 296, the aperture 316 (FIG. 29) of the linking member 310, and the aperture 308 (FIG. 26) of the second U-shaped pivot member 296. The pin 330 has an interference fit in the apertures 306 and 308 in the second U-shaped pivot member 296.

A spring 332 has one end thereof mounted on the peg 318 of the linking member 310, and the other end thereof mounted on the pin 324. It will be appreciated by those skilled in the art that the first and second U-shaped support members 266 will be mounted in the base rail 62 (illustrated in FIGS. 1 and 2). The pressure bar 64 will move between its first position shown in FIG. 31 and its second position shown in FIG. 32. The first position of the pressure bar 64 is thus relatively further away from the base rail 62, and the second position of the pressure bar 64 is thus relatively closer to the base rail 62. The spring 332 urges the pressure bar 64 from its second position to its first position.

Figures 33, 35, 36, 37, 38, 40, 41:
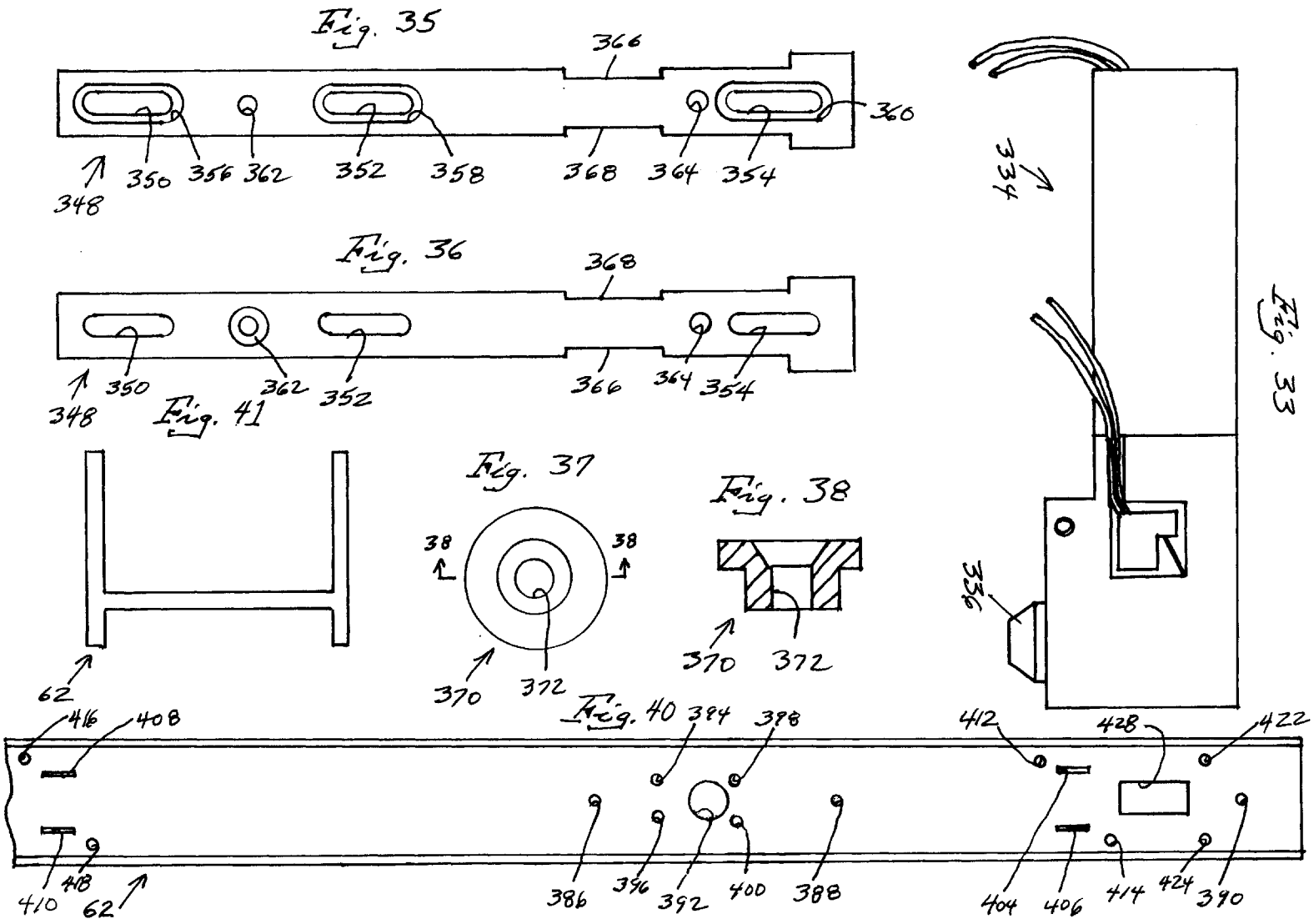
FIG. 33 is a side plan view of a solenoid actuator having a shaft which may alternately be extended and retracted.
FIG. 35 is bottom plan view of a long, flat lock plate showing three slots which are located along the length thereof and which have recesses surrounding them on the bottom side of the lock plate, and also showing two additional apertures extending therethrough.
FIG. 36 is a top plan view of the lock plate illustrated in FIG. 35, showing the frustroconical configuration of one of the apertures extending therethrough.
FIG. 37 is a bottom plan view of a retaining post having a smaller diameter portion extending from a larger diameter portion.
FIG. 38 is a cross-sectional view of the retaining post illustrate An FIG. 37, showing a countersunk aperture extending therethrough.
FIG. 40 is a top plan view of the base rail illustrated in FIGS. 1 and 2, showing a plurality of apertures and slots located therein.
FIG. 41 is an end view of the base rail illustrated in FIG. 40, showing the configuration thereof.

Referring now to FIGS. 33 and 34, a solenoid actuator 334 is illustrated which is used to lock and unlock the door access locking bar of the present invention. The solenoid actuator 334 is similar to the device shown in U.S. Pat. No. 4,634,155, to Gerringer et al. U.S. Pat. No. 4,634,155 is hereby incorporated herein by reference. When the solenoid actuator 334 is energized, a shaft 336 is extended from the housing 338 of the solenoid actuator 334. When the solenoid actuator 334 is not energized, the shaft 336 is retracted into the housing 338 of the solenoid actuator 334. In the preferred embodiment, the shaft 336 has a frustroconical taper on its distal end. The portion of the housing 338 of the solenoid actuator 334 surrounding the shaft 336 has four threaded apertures 340, 342, 344, and 346 located therein for use in mounting the solenoid actuator 334.

Referring next to FIGS. 35 and 36, a long, flat lock plate 348 is illustrated which will be mounted on the opposite side of the base rail 62 from the pressure bar illustrated in FIGS. 31 and 32. The lock plate 348 has three circular oblong slots 350, 352, and 354 which are located along the length thereof. The slots 350, 352, and 354 have circular oblong recesses 356, 358, and 360, respectively surrounding them on the bottom side of the lock plate 348 as shown in FIG. 35.

Located in the lock plate 348 intermediate the oblong slots 350 and 352 is a frustroconical aperture which extends therethrough. The larger diameter portion of the frustroconical aperture 362 is located on the side of the lock plate 348 opposite the side in which the recesses 356, 358, and 360 are located. Located adjacent the recess 360 on the end toward the recess 358 is an aperture 364 which extends through the lock plate 348. Located on opposite side edges of the lock plate 348 on the side of the aperture 364 opposite to the recess 360 are two notches 366 and 368.

Referring now to FIGS. 37 and 38, a retaining post 370 is illustrated which essentially comprises a larger diameter cylindrical portion sitting atop a smaller diameter cylindrical portion. The diameter of the smaller portion of the retaining post 370 is sized to fit within the slots 350, 352, or 354

(illustrated in FIG. 35). The diameter of the larger portion of the retaining post 370 is sized to fit within the recesses 356, 358, or 360 (illustrated in FIG. 35). The retaining post 370 has a countersunk aperture 372 extending therethrough, the countersunk portion lying in the larger diameter portion of the retaining post 370.

Figure 39:
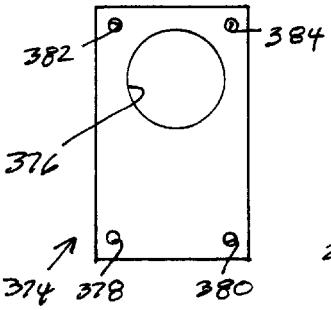
FIG. 39 is a top plan view of a spacer plate for installation onto the bottom of the solenoid actuator illustrated in FIGS. 33 and 34, showing a plurality of apertures extending therethrough.

Referring next to FIG. 39, a spacer plate 374 for installation onto the bottom of the solenoid actuator 334 (illustrated in FIGS. 33 and 34) is shown. The spacer plate 374 has a large aperture through which the shaft 336 (also illustrated in FIGS. 33 and 34) of the solenoid actuator 334 may extend. Also located in the spacer plate 374 are four apertures 378, 380, 382, and 384 which extend therethrough. These apertures 378, 380, 382, and 384 have the same configuration as the apertures 340, 342, 344, and 346 (also illustrated in FIGS. 33 and 34) in the housing 338 of the solenoid actuator 334.

Figures 42, 43, 44:
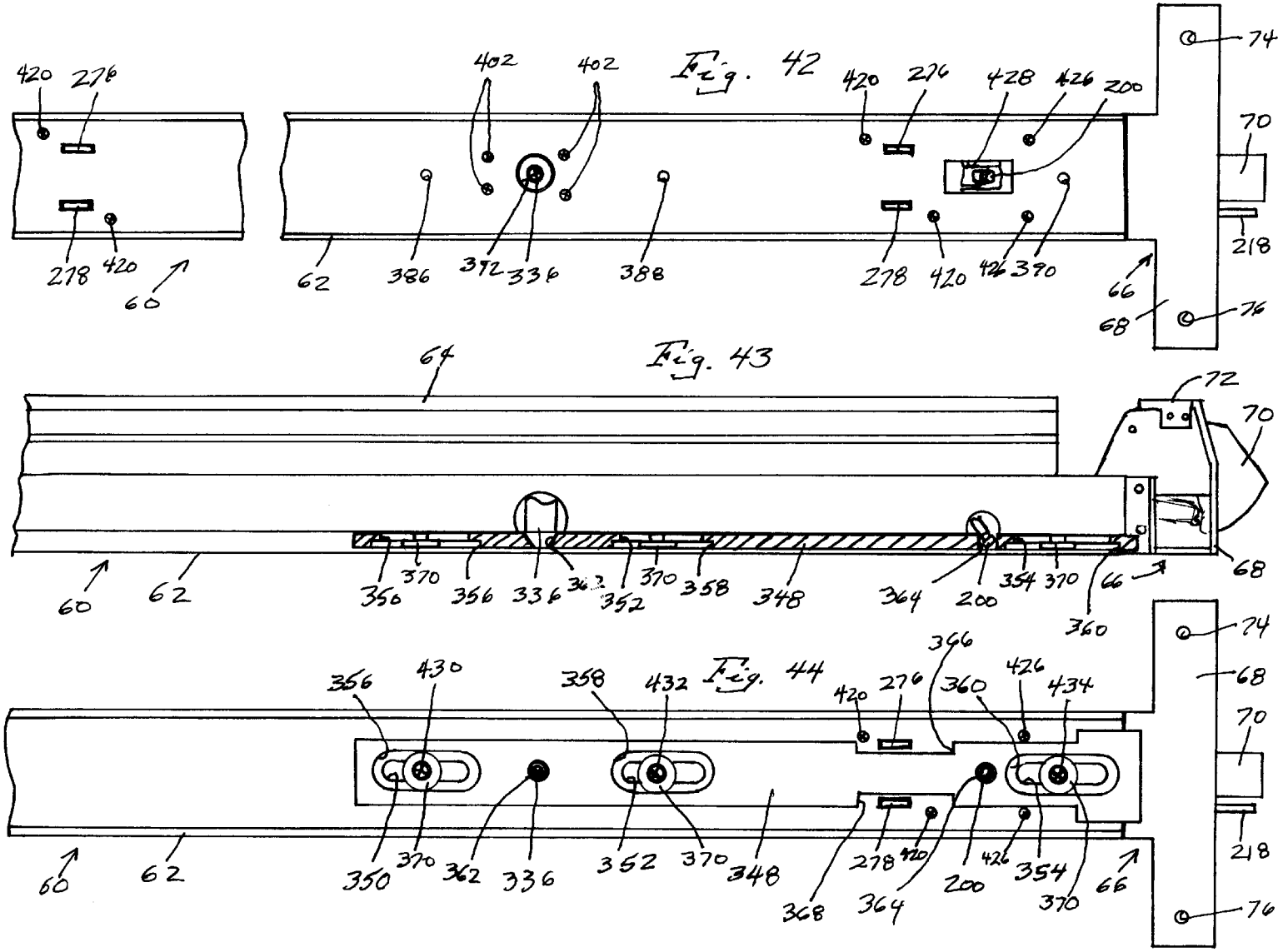
FIG. 42 is a bottom plan view of the base rail illustrated in FIGS. 40 and 41 with the latching assembly illustrated in FIGS. 9 through 16, the solenoid actuator illustrated in FIGS. 33 and 34, and the pressure bar assembly illustrated in 31 and 32 assembled into the base rail.
FIG. 43 is a somewhat schematic, partially cutaway side view of the assembly illustrated in FIG. 42 with the lock plate illustrated in FIGS. 35 and 36 assembled thereto with the retaining posts illustrated in FIGS. 37 and 38, showing the door access locking bar of the present invention with the pressure bar in its first undepressed position, the shaft of the solenoid actuator in its extended position to engage the lock plate, and the latching mechanism being retained in the locked position.
FIG. 44 is a bottom view of the door access locking bar as illustrated in FIG. 43.

Referring now to FIGS. 40 through 42, the base rail 62 is shown in detail. In cross section, the base rail 62 is H-shaped, with the portions of the legs of the H which are above the crossbar of the H being longer that the portions of the legs of the H below the crossbar. The latching mechanism 66 (illustrated in FIGS. 9 through 19), the pressure bar assembly (illustrated in FIGS. 31 and 32), and the solenoid actuator 334 (illustrated in FIGS. 33 and 34) will be mounted in the base rail 62 above the crossbar of the H, while the lock plate 348 (illustrated in FIGS. 35 and 36) will be mounted in the base rail 62 below the crossbar of the H.

Three threaded apertures 386, 388, and 390 are located in the crossbar of the H of the base rail 62, and are spaced the same distances apart as are the slots 350, 352, and 354 in the lock plate 348 (illustrated in FIGS. 35 and 36). Located in the crossbar of the H of the base rail 62 intermediate the threaded apertures 386 and 388 is a large aperture 392 through which the shaft 336 of the solenoid actuator 334 (illustrated in FIGS. 33 and 34) may extend. Located in the crossbar of the H of the base rail 62 around the large aperture 392 are four smaller countersunk apertures 394, 396, 398, and 400 which extend therethrough. These countersunk apertures 394, 396, 398, and 400 have the same configuration as the apertures 340, 342, 344, and 346 (also illustrated in FIGS. 33 and 34) in the housing 338 of the solenoid actuator 334.

Four flathead screws 402 are used to retain the solenoid actuator 334 (illustrated in FIGS. 33 and 34) and the spacer plate 374 (illustrated in FIG. 39) to the base rail 62. The first flathead screw 402 extends sequentially through the countersunk aperture 394 in the base rail 62, the aperture 378 (FIG. 39) in the spacer plate 374, and is screwed into the threaded aperture 340 (FIG. 34) in the housing 338 of the solenoid actuator 334. The second flathead screw 402 extends sequentially through the countersunk aperture 396 in the base rail 62, the aperture 380 (FIG. 39) in the spacer plate 374, and is screwed into the threaded aperture 342 (FIG. 34) in the housing 338 of the solenoid actuator 334. The third flathead screw 402 extends sequentially through the countersunk aperture 398 in the base rail 62, the aperture 382 (FIG. 39) in the spacer plate 374, and is screwed into the threaded aperture 344 (FIG. 34) in the housing 338 of the solenoid actuator 334. The fourth flathead screw 402 extends sequentially through the countersunk aperture 400 in the base rail 62, the aperture 384 (FIG. 39) in the spacer plate 374, and is screwed into the threaded aperture 346 (FIG. 34) in the housing 338 of the solenoid actuator 334.

Two pairs of parallel slots are located in the crossbar of the H of the base rail 62, a nd are spaced the same distances apart as are the first and second the U-shaped support members 266 (illustrated in FIGS. 31 and 32). A first pair of slots 404 and 406 are located intermediate the threaded apertures 388 and 390, and a second pair of slots 408 and 410 are located the requisite distance away. A first pairs of countersunk apertures 412 and 414 are diagonally oriented around the slots 404 and 406, and a second pair of countersunk apertures 416 and 418 are diagonally oriented around the slots 408 and 410.

Four flathead screws 420 are used to retain the pressure bar assembly in the base rail 62. The tabs 276 and 278 of the first U-shaped support member 266 (illustrated in FIGS. 31 and 32) are inserted into the slots 404 and 406, respectively, of the base rail 62 as shown in FIG. 42. Similarly, the tabs 276 a nd 278 of the second U-shaped support member 266 (illustrated in FIGS. 31 and 32) are inserted into the slots 408 and 410, respectively, of the base rail 62 as shown in FIG. 42.

The first flathead screw 420 is inserted through the countersunk aperture 412 in the base rail 62 and is screwed into the threaded aperture 292 (FIG. 24) of the first U-shaped support member 266. The second flathead screw 420 is inserted through the countersunk aperture 414 in the base rail 62 and is screwed into the threaded aperture 290 (FIG. 24) of the first U-shaped support member 266. The third flathead screw 420 is inserted through the countersunk aperture 416 in the base rail 62 and is screwed into the threaded aperture 292 (FIG. 24) of the first U-shaped support member 266. The fourth flathead screw 420 is inserted through the countersunk aperture 418 in the base rail 62 and is screwed into the threaded aperture 290 (FIG. 24) of the first U-shaped support member 266.

A pair of countersunk apertures 422 and 424 are located in the crossbar of the H of the base rail 62 just to the left of the threaded aperture 390. The countersunk apertures 422 and 424 are spaced the same distances apart as are the apertures 156 and 158 in the base member 108 of the latching mechanism housing member 106 (illustrated in FIG. 7). The latching mechanism 66 is installed in the base rail 62 with two countersunk screws 426. The first countersunk screw 426 extends through the countersunk aperture 422 in the base rail 62 and is screwed into the aperture 156 (illustrated in FIG. 7) in the base member 108 of the latching mechanism housing member 106. The second countersunk screw 426 extends through the countersunk aperture 424 in the base rail 62 and is screwed into the aperture 158 (illustrated in FIG. 7) in the base member 108 of the latching mechanism housing member 106.

A rectangular aperture 428 is centrally located in the crossbar of the H of the base rail 62 intermediate the slots 406 and 408 and the threaded aperture 390. The pivoting pin 200 of the latching mechanism 66 extends through the rectangular aperture 428.

Referring now to FIGS. 43 through 46, the installation of the lock plate 348 may now be described. The pivoting pin 200 of the latching mechanism 66 fits into the aperture 364 of the lock plate 348. Three retaining posts 370 are used to retain the lock plate 348 in position on the base rail 62. A first retaining post 370 is held in position in the recess 356 surrounding the slot 350 with a flathead screw 430, which is screwed into the threaded aperture 386 (illustrated in FIG. 40). A second retaining post 370 is held in position in the recess 358 surrounding the slot 352 with a flathead screw 432, which is screwed into the threaded aperture 388 (illustrated in FIG. 40). A third retaining post 372 is held in position in the recess 360 surrounding the slot 354 with a flathead screw 434, which is screwed into the threaded aperture 390 (illustrated in FIG. 40).

Figure 45:
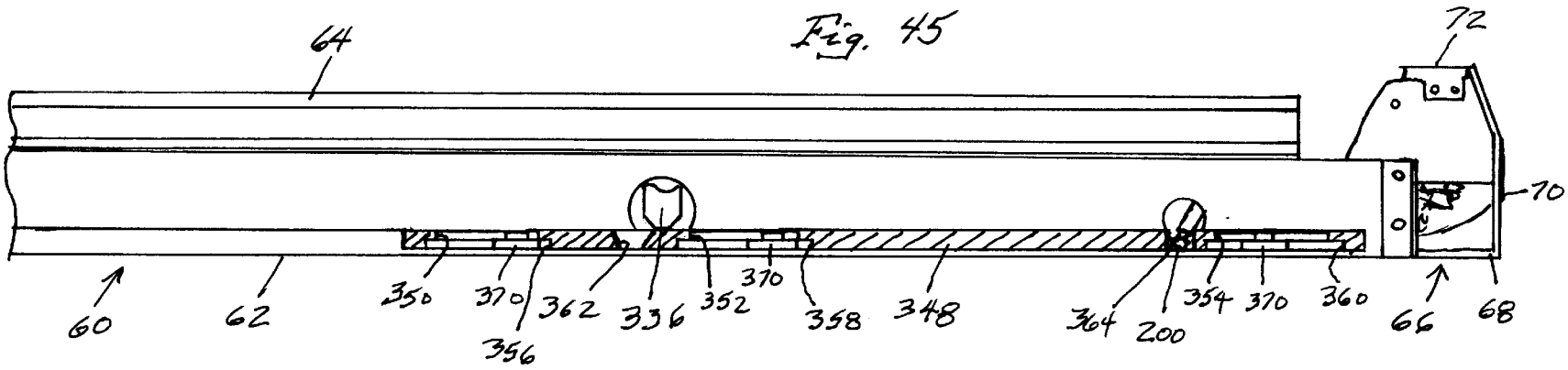
FIG. 45 is a somewhat schematic, partially cutaway side view of the door access locking bar illustrated in FIGS. 43 and 44 with the shaft of the solenoid actuator (not shown in FIG. 45) in its retracted position to disengage the lock plate, showing the door access locking bar of the present invention with the pressure bar in its second depressed position, and the latching mechanism in the unlocked position.
Figure 46:
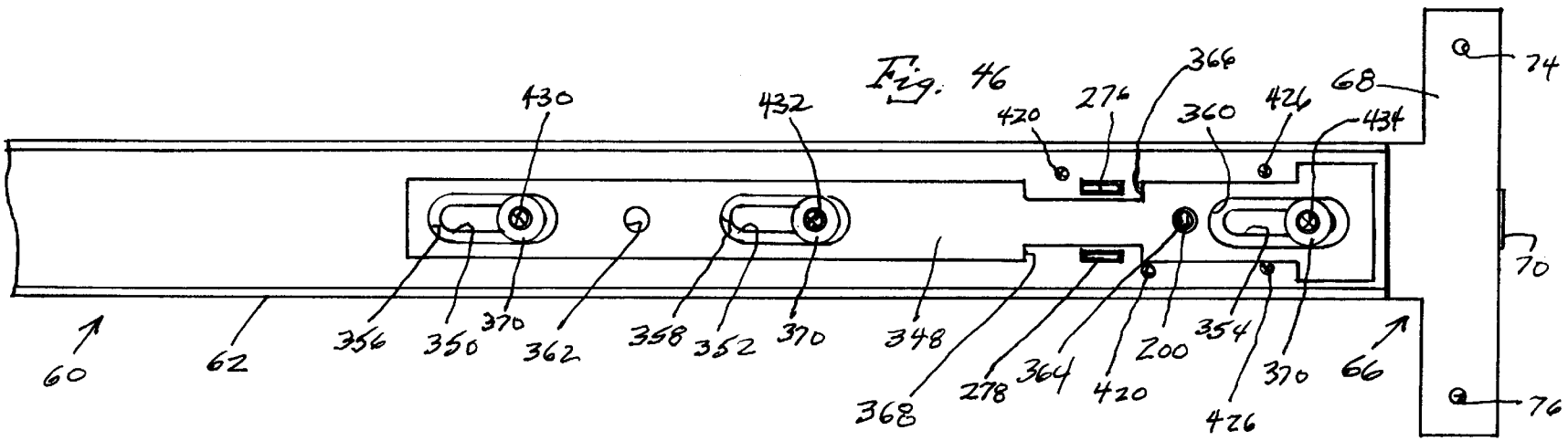
FIG. 46 is a bottom view of the door access locking bar as illustrated in FIG. 45.

Operation of the lock plate 348 may now be described, also with reference to FIGS. 43 through 46. The lock plate 348 slides between first and second positions on the base rail 62. The first position of the lock plate 348 is illustrated in FIGS. 43 and 44, and the second position of the lock plate 348 is illustrated in FIGS. 45 and 46.

It will at once be appreciated by those skilled in the art that when the solenoid actuator 334 (illustrated in FIGS. 33 and 34) is energized, the shaft 336 of the solenoid actuator 334 will extend into the frustroconical aperture 362 of the lock plate 348, thereby preventing the lock plate 348 from sliding on the base rail 62 from its first position to its second position. The shaft 336 of the solenoid actuator 334 and the frustroconical aperture 362 of the flat head bolts 248 have frustroconical tapers so that when the solenoid actuator 334 is not energized but the shaft 336 has not been withdrawn, it will be forced out of the frustroconical aperture 362 when the lock plate 348 slides from its first position to its second position on the base rail 62.

The sliding movement of the lock plate 348 on the base rail 62 is driven by the pivoting pin 200 of the latching mechanism 66, which engages the lock plate 348 as it extends through the aperture 364 in the lock plate 348. Thus, if the solenoid actuator 334 is energized and the shaft 336 of the solenoid actuator 334 is in the frustroconical aperture 362 of the lock plate 348, the lock plate 348 will prevent the pivoting pin 200 from moving from its first position to its second position. Thus, the latching mechanism 66 is locked, and pressure exerted on the pressure bar 64 will not be able to drive the latching mechanism 66 to open the bolt 70.

It should be noted that there must be a small amount of play between the pivoting pin 200 and the aperture 364 in the lock plate 348. This is necessary in order to allow pressure on the pressure bar 64 to move the drive arm 180 (illustrated in FIGS. 9 through 16) incrementally to actuate the microswitch 246, in the manner described above. The amount of play between the pivoting pin 200 and the aperture 364 in the lock plate 348, however, allows nowhere close to the amount of movement of the drive arm 180 necessary to drive the bolt 70 from its first extended position to its second retracted position.

One additional aspect of the door access locking bar of the present invention which bears mention is the unique directional correlation between the various components of the door access locking bar. Movement of the pressure bar 64 in a first direction in a first axis is translated to movement of the bolt 70 in a second direction in a second axis orthogonal to the first axis (or about a third axis orthogonal to both the first and the second axes). Movement of the lock plate 348 is in a third direction opposite to the second direction. Movement of the shaft 336 of the solenoid actuator 334 is reciprocal in the directions of first axis. This configuration is believed to optimize the operation of the door access locking bar of the present invention.

It may therefore be appreciated from the above detailed description of the preferred embodiment of the present invention that it teaches an improved door access bar having an electromechanical locking mechanism incorporated therein to selectively lock and unlock a door on which the door access locking bar is mounted to thereby control access or egress through the door. The locking mechanism of the door access locking bar of the present invention will positively prevent the door from being opened until the electromechanical locking mechanism is operated to do so. The locking mechanism is integrated into the design of the door access locking bar, and is not visible from the exterior of the door access locking bar.

The switch of the door access locking bar of the present invention which indicates that access or egress is desired is triggered by pressure on the door access locking bar. Despite the incorporation of these aspects, the door access locking bar of the present invention presents a low-profile design similar to that of a conventional door access bar. The mechanical design of the door access locking bar of the present invention incorporates an interlock mechanism to positively prevent the bolt from being forced into a retracted position by jimmying the locking mechanism to unlock the door.

The door access locking bar of the present invention operates in a fail-safe manner such that, in the event of a power failure, it will automatically be placed into an unlocked position. It allows the bolt to retract as the door is closed without first requiring that the unlocking mechanism be actuated. The door access locking bar of the present invention is of a robust design so as to not require frequent adjustment of mechanical tolerances within the device, and is both easy and quick to mount on any door or other desired location.

The door access locking bar of the present invention is of a construction which is both durable and long lasting, and which will require little or no maintenance to be provided by the user throughout its operating lifetime. It is also of inexpensive construction to enhance its market appeal and to thereby afford it the broadest possible market. Finally, all of the aforesaid advantages and objectives of the apparatus of the door access locking bar of the present invention are achieved without incurring any substantial relative disadvantage.

Although an exemplary embodiment of the door access locking bar of the present invention has been shown and described with reference to particular embodiments and applications thereof, it will be apparent to those having ordinary skill in the art that a number of changes, modifications, or alterations to the invention as described herein may be made, none of which depart from the spirit or scope of the present invention. All such changes, modifications, and alterations should therefore be seen as being within the scope of the present invention.

What is claimed is:

1. A door access bar for installation onto a door hingedly mounted in a door frame, said door access bar comprising:

a housing for installation onto the door;

a pressure bar mounted on said housing for movement between a first position relatively away from said housing and a second position relatively toward said housing;

a bolt installed in said housing, said bolt being moveable between a first position in which said bolt is extended from said housing and a second position in which said bolt is retracted into said housing;

a latch mechanism installed in said housing, said latch mechanism being driven by movement of said pressure bar to drive said bolt, said latch mechanism driving said bolt from its first extended position to its second retracted position when said pressure bar is moved from its first position to its second position;

a reciprocating means installed in said housing, said reciprocating means being moveable between first and second positions, said reciprocating means being driven from its first position to its second position by said latch mechanism as said latch mechanism moves said bolt from its first extended position to its second retracted position, wherein said reciprocating means will inhibit said latch mechanism from driving said bolt from its first extended position to its second retracted position if said reciprocating means is retained in its first position; and an electromechanical device installed in said housing, said electromechanical device being driven between first and second positions by the application and removal of electricity thereto, wherein said electromechanical device will retain said reciprocating means in its first position when said electromechanical device is in its first position.

2. A door access bar as defined in claim 1, wherein said housing comprises:

a base rail having an H-shaped cross-sectional configuration; and a latching mechanism housing in which said latch mechanism is installed, said latching mechanism housing being mounted onto said base rail.

3. A door access bar as defined in claim 2, wherein said H-shaped configuration of said base rail defines two sides of said base rail on opposite sides of the crossbar of the H, wherein said pressure bar and said latching mechanism is mounted on one side of said base rail, and wherein said reciprocating means is mounted on the other side of said base rail.

4. A door access bar as defined in claim 1, additionally comprising:

pressure bar mounting apparatus mounted in said housing, said pressure bar mounting apparatus supporting said pressure bar for movement between its first and second positions such that the position of said pressure bar in its first position is parallel to the position of said pressure bar in its second position.

5. A door access bar as defined in claim 4, wherein said pressure bar mounting apparatus is arranged and configured to minimize longitudinal movement of said pressure bar between its first and second positions.

6. A door access bar as defined in claim 4, wherein said pressure bar mounting apparatus comprises:

means for biasing said pressure bar from its second position toward its first position.

7. A door access bar as defined in claim 6, wherein said biasing means comprises:

a spring.

8. A door access bar as defined in claim 4, wherein said pressure bar comprises:

at least one member mounted on an end of said pressure bar, said at least one member moving in a first axis relatively toward and away from the door as said pressure bar moves between its first and second positions, said first axis being essentially orthogonal to the movement of said bolt as it is retracted into said housing when it moves between its first extended position and its second retracted position.

9. A door access bar as defined in claim 1, wherein said bolt is pivotally mounted to move between its first extended position and its second retracted position.

10. A door access bar as defined in claim 1, wherein said pressure bar defines a first axis of movement as it moves between its first and second positions, and wherein said bolt defines a second axis of movement as it moves between its first extended position and its second retracted position, said first axis and said second axis being essentially orthogonal.

11. A door access bar as defined in claim 10, wherein said reciprocating means moves essentially in said second axis as it moves between its first and second positions, but in a direction which is opposite to the motion of said bolt.

12. A door access bar as defined in claim 1, wherein said reciprocating means has an aperture disposed therein, and wherein said electromechanical device comprises:

a shaft which is driven by said electromechanical device between first and second positions, said shaft having an axis which is coaxial with the axis of said aperture in said reciprocating means when said reciprocating means member is in its first position, said shaft of said electromechanical device engaging said aperture in said reciprocating means when said reciprocating means is in its first position and said electromechanical device is in its first position.

13. A door access bar as defined in claim 12, wherein said aperture in said reciprocating means comprises:

a frustroconical aperture; and wherein said shaft of said electromechanical device comprises:

a frustroconical segment located at a distal end of said shaft of said electromechanical device.

14. A door access bar as defined in claim 1, wherein said electromechanical device comprises:

a solenoid actuator.

15. A door access bar as defined in claim 14, wherein said solenoid actuator comprises:

a shaft which is driven by said solenoid actuator between a first extended position and a second retracted position, said first extended position of said shaft of said solenoid actuator corresponding to said first position of said electromechanical device, said second retracted position of said shaft of said solenoid actuator corresponding to said second position of said electromechanical device.

16. A door access bar as defined in claim 15, wherein said shaft of said solenoid actuator is in its first extended position when said solenoid is energized by the application of electricity thereto, and wherein said shaft of said solenoid actuator is in its second retracted position when said solenoid is not energized due to the removal of electricity therefrom.

17. A door access bar as defined in claim 1, additionally comprising:

means for biasing said bolt from its second retracted position toward its first extended position.

18. A door access bar as defined in claim 17, wherein said biasing means comprises:

a spring.

19. A door access bar as defined in claim 1, additionally comprising:

means for detecting the presence of pressure exerted on said pressure bar and generating an electrical signal in response thereto, said electrical signal being useable by an external control system to initiate the generation of a change in state of the application of electricity to or the removal of electricity from said electromechanical device to cause said electromechanical device to change from its first position to its second position.

20. A door access bar as defined in claim 19, wherein said latch mechanism is arranged and configured to provide a mechanical signal in response to the application of pressure on said pressure bar without driving said reciprocating means from its first position to its second position, said door access bar additionally comprising:

a switch which detects said mechanical signal from said latch mechanism and provides said electrical signal in response thereto.

21. A door access bar as defined in claim 1, additionally comprising:

an interlock mechanism installed in said housing, said interlock mechanism preventing said bolt from being driven from its first extended position to its second retracted position by the application of external force directly to said bolt without said pressure bar moving from its first position to its second position.

22. A door access bar as defined in claim 21, wherein said interlock mechanism comprises:

a cam member installed in said housing, said cam member being moveable between a first position in which said cam member is extended from said housing and a second position in which said cam member is retracted into said housing, said cam member being driven from its first extended position to its second retracted position when the door is moved from a closed position to an open position; and an interlock member mounted in said housing, said interlock member having a first position and a second position, said interlock member preventing said bolt from being moved from its first extended position to its second retracted position when said interlock member is in its second position, said interlock member allowing said bolt to be moved from its first extended position to its second retracted position when said interlock member is in its first position, said interlock member being driven from its first position to its second position when said cam member moves from its first extended position to its second retracted position.

23. A door access bar as defined in claim 22, additionally comprising:

a peg mounted on said bolt, said peg being engaged by said interlock member when said interlock member is in its second position.

24. A door access bar as defined in claim 22, wherein said latch mechanism additionally comprises:

a bypass member mounted in said housing, said bypass member being in engagement with said interlock member to drive said interlock member from its second position to its first position irrespective of the position of said cam member whenever pressure is exerted on said pressure bar.

25. A door access bar as defined in claim 24, wherein said interlock member has a third position, said door access bar additionally comprising:

a peg mounted on said bolt, said peg engaging said interlock member to drive said interlock member from its first position to its third position when said bolt is driven by said latch mechanism from its first extended position to its second retracted position.

26. A door access bar as defined in claim 25, additionally comprising:

a switch operated by said interlock member, said switch providing a first output when said interlock member is in its first position, a second output when said interlock member is in its second position, and a third output when said interlock member is in its third position.

27. A door access bar as defined in claim 1, wherein said latch mechanism comprises:

a drive arm mounted in said housing, said drive arm being moveable between a first position and a second position, said drive arm being engaged by said pressure bar as said pressure bar moves from its first position to its second position to drive said drive arm from its first position to its second position, said drive arm in turn engaging said bolt to drive said bolt from its first extended position to its second retracted position as said drive arm moves from its first position to its second position.

28. A door access bar as defined in claim 27, wherein said latch mechanism additionally comprises:

a pin member mounted in said housing, said pin member being moveable between a first position and a second position, said drive arm engaging said pin member to drive said pin member from its first position to its second position as said drive arm moves from its first position to its second position;

and wherein said reciprocating means comprises:

an aperture disposed in said reciprocating member, said pin member having a distal end which extends through said aperture in said reciprocating means, said pin member thereby engaging said reciprocating means.

29. A door access bar as defined in claim 28, wherein said distal end of said pin member and said aperture in said reciprocating means are configured such that said pin member can move incrementally from its first position toward its second position without moving said reciprocating means even incrementally from its first position toward its second position.

30. A door access bar as defined in claim 29, additionally comprising:

means for detecting incremental movement of said drive arm from its first position toward its second position caused by the presence of pressure exerted on said pressure bar and generating an electrical signal in response thereto, said electrical signal being useable by an external control system to initiate the generation of a change in state of the application of electricity to or the removal of electricity from said electromechanical device to cause said electromechanical device to change from its first position to its second position.

31. A door access bar as defined in claim 27, wherein said drive arm and said bolt are configured such that said drive arm can move incrementally from its first position toward its second position without moving said bolt even incrementally from its first extended position toward its second retracted position.

32. A door access bar as defined in claim 31, additionally comprising:

means for detecting incremental movement of said drive arm from its first position toward its second position caused by the presence of pressure exerted on said pressure bar and generating an electrical signal in response thereto, said electrical signal being useable by an external control system to initiate the generation of a change in state of the application of electricity to or the removal of electricity from said electromechanical device to cause said electromechanical device to change from its first position to its second position.

33. A door access bar for installation onto a door hingedly mounted in a door frame, said door access bar comprising:

a base member for installation onto the door;

a pressure bar mounted on said base member for movement between a first position relatively away from said base member and a second position relatively toward said base member;

a first spring which biases said pressure bar from its second position toward its first position;

a latch mechanism housing mounted on said base member;

a bolt installed in said latch mechanism housing, said bolt being moveable about a between a first position in which said bolt is extended from said latch mechanism housing and a second position in which said bolt is retracted into said latch mechanism housing;

a second spring which biases said bolt from its second retracted position toward its first extended position a latch mechanism installed in said latch mechanism housing, said latch mechanism being driven by movement of said pressure bar to drive said bolt, said latch mechanism driving said bolt from its first extended position to its second retracted position when said pressure bar is moved from its first position to its second position;

a reciprocating means installed in said base member, said reciprocating means being moveable between first and second positions, said reciprocating means being driven from its first position to its second position by said latch mechanism as said latch mechanism moves said bolt from its first extended position to its second retracted position, wherein said reciprocating means will inhibit said latch mechanism from driving said bolt from its first extended position to its second retracted position if said reciprocating means is in retained its first position;

a solenoid actuator installed in said base member, said solenoid actuator being driven from a first position to a second position by the application of electricity thereto, wherein said solenoid actuator will retain said reciprocating means in its first position when said solenoid actuator is in its second position; and means for detecting the presence of pressure exerted on said pressure bar and generating an electrical signal in response thereto.

34. A method of making an electrically activated door access locking bar for selectively, alternatively electrically locking and unlocking a door hingedly mounted in a door frame, said method comprising:

providing a housing member for installation onto the door;

mounting a pressure bar on said housing member for movement between a first position relatively away from said housing member and a second position relatively toward said housing member;

installing a bolt in said housing member, said bolt being moveable between a first position in which said bolt is extended from said housing member and a second position in which said bolt is retracted into said housing member;

installing a latch mechanism in said housing member, said latch mechanism being driven by movement of said pressure bar to drive said bolt, said latch mechanism driving said bolt from its first extended position to its second retracted position when said pressure bar is moved from its first position to its second position;

installing a reciprocating means in said housing, said reciprocating means being moveable between first and second positions, said reciprocating means being driven from its first position to its second position by said latch mechanism as said latch mechanism moves said bolt from its first extended position to its second retracted position, wherein said reciprocating means will inhibit said latch mechanism from driving said bolt from its first extended position to its second retracted position if said reciprocating means is in retained its first position; and installing an electromechanical device in said housing member, said electromechanical device being driven between first and second positions by the application and removal of electricity thereto, wherein said electromechanical device will retain said reciprocating means in its first position when said electromechanical device is in its first position.

* * * * *